US012716197B2

(12) United States Patent
Kitahara et al.

(10) Patent No.: US 12,716,197 B2
(45) Date of Patent: Aug. 25, 2026

(54) CONSTRUCTION MACHINE

(71) Applicant: Yanmar Holdings Co., Ltd., Osaka (JP)

(72) Inventors: Satoshi Kitahara, Fukuoka (JP); Jun Terashima, Fukuoka (JP)

(73) Assignee: Yanmar Holdings Co., Ltd., Osaka (JP)

( * ) Notice: Subject to any disclaimer, the term of this patent is extended or adjusted under 35 U.S.C. 154(b) by 281 days.

(21) Appl. No.: 18/036,895

(22) PCT Filed: Nov. 30, 2021

(86) PCT No.: PCT/JP2021/043732
§ 371 (c)(1),
(2) Date: May 15, 2023

(87) PCT Pub. No.: WO2022/130957
PCT Pub. Date: Jun. 23, 2022

(65) Prior Publication Data

US 2023/0417015 A1 Dec. 28, 2023

(30) Foreign Application Priority Data

Dec. 18, 2020 (JP) ..... 2020-210453

(51) Int. Cl.
*E02F 9/08* (2006.01)
*E02F 9/16* (2006.01)

(52) U.S. Cl.
CPC ..... *E02F 9/0866* (2013.01); *E02F 9/0808* (2013.01); *E02F 9/16* (2013.01)

(58) Field of Classification Search
CPC ..... E02F 9/0866; E02F 9/0808; E02F 9/16
(Continued)

(56) References Cited

U.S. PATENT DOCUMENTS 10,749,224 B2 * 8/2020 Podolefsky ..... H01M 50/224
2013/0071212 A1 * 3/2013 Yunoue ..... E02F 9/0883 414/685
2013/0141889 A1 * 6/2013 Tsuchiya ..... H01G 2/103 361/821

FOREIGN PATENT DOCUMENTS

JP H11100861 * 4/1999 ..... E02F 9/00
JP H11100861 A * 4/1999 ..... E02F 9/00
(Continued)

*Primary Examiner* — Hau V Phan
(74) *Attorney, Agent, or Firm* — Chris Mizumoto

(57) ABSTRACT

In a configuration in which a battery unit for supplying power to an electric motor is provided, the present invention effectively suppresses the vibration of the battery unit using a simple and inexpensive configuration. The present invention comprises: an electric motor; a battery unit for supplying power to the electric motor; a lower-side vibration-damping support part that, with respect to an upper turning body in which the battery unit is installed, dampens the vibration of and supports the lower side of the battery unit; and an upper-side vibration-damping support part that, with respect to the upper turning body, dampens the vibration of and supports the upper side of the battery unit. The lower-side vibration-damping support part is provided to one side of the battery unit in the front-rear direction, and the upper-side vibration-damping support part is provided to the other side of the battery unit in the front-rear direction.

9 Claims, 14 Drawing Sheets

(58) Field of Classification Search
USPC ..... 180/68.5
See application file for complete search history.

(56) References Cited

FOREIGN PATENT DOCUMENTS

| | | | | | |
|---|---|---|---|---|---|
| JP | 2001329567 | A | | 11/2001 | |
| JP | 2004152524 | | * | 5/2004 | ..... E02F 9/00 |
| JP | 2004152524 | A | * | 5/2004 | ..... Y02E 60/12 |
| JP | 2006069357 | A | | 3/2006 | |
| JP | 2012201188 | A | | 10/2012 | |
| JP | 2012211469 | | * | 11/2012 | ..... E02F 9/20 |
| JP | 2013139676 | A | | 7/2013 | |
| JP | 2014159719 | A | | 9/2014 | |
| JP | 5957475 | B2 | | 7/2016 | |
| WO | WO 2011158686 | | * | 12/2011 | ..... B60K 1/04 |

* cited by examiner

CONSTRUCTION MACHINE

CROSS-REFERENCE

This application is a US National Stage Application under 35 U.S.C. § 371 of International Application No. PCT/JP2021/043732 filed Nov. 30, 2021, which claims foreign priority of JP2020-210453 filed Dec. 18, 2020 and the disclosures of which are hereby incorporated by reference in their entirety.

TECHNICAL FIELD

The present invention relates to construction machine provided with an electric motor as a drive source and a battery unit for supplying power to the electric motor.

BACKGROUND ART

Conventionally, in construction machines such as excavators, for example, there is one that is of electrically driven type which is provided with an electric motor as a drive source. As an electrically-driven construction machine, for example, there is an excavator which is provided with a lower run body and an upper swing body so installed as to be swingable relative to the lower run body, and in which an electric motor is installed on the upper swing body (see Patent Literature 1 and Patent Literature 2, for example). The electrically-driven construction machine is provided with a battery unit for supplying power to the electric motor (refer to Patent Literature 1 and Patent Literature 2, for example).

Patent Literature 1 discloses an electrically-driven excavator in which in the upper swing body, the electric motor connected to a hydraulic pump is placed on the side of a battery unit provided below a drive part.

Since the excavator causes a relatively large vibration during work, it is desirable that the battery unit and the electric motor, in a machine body, should be supported in a vibration-proof manner. Patent Literature 2 discloses a configuration in which, in the back part of the upper swing body, a battery unit having a plurality of batteries stored in a shelf-like member in a given arrangement is installed, and the upper and lower of the battery unit are supported in a vibration-proof manner to a swing frame of the upper swing body by a vibration-proof member including a vibration-proof rubber.

CITATION LIST

Patent Literature

Patent Literature 1: Japanese Unexamined Patent Application Publication No. 2020-045630

Patent Literature 2: Japanese Unexamined Patent Application Publication No. 2013-139675

DISCLOSURE OF INVENTION

Problems to be Solved by the Invention

The vibration during the work of the excavator includes a vibration of components in various directions; thus, there is a problem that merely placing the vibration-proof members above and below the battery unit, as in the configuration disclosed in Patent Literature 2, for example, is not sufficient to sufficiently suppress the vibration. Further, increasing the number of points for supporting by the vibration-proof member can increase an effect of suppressing the vibration, but increasing the number of points for supporting by the vibration-proof member can lead to an increased cost and a more complex structure.

The present invention has been made in view of the above problem; it is an object of the present invention is to provide a construction machine that, in a configuration provided with a battery unit for supplying electric power to an electric motor, can effectively suppress a vibration of the battery unit by a simple and inexpensive configuration.

Means for Solving the Problems

A construction machine according to the present invention includes: an electric motor; a battery unit for supplying electric power to an electric motor; a lower vibration-proof support part for supporting a lower side of the battery unit in a vibration-proof manner to a machine body in which the battery unit is placed; and an upper vibration-proof support part for supporting an upper side of the battery unit in a vibration-proof manner to the machine body, wherein the lower vibration-proof support part is provided on one side of the battery unit in a front and back direction, and the upper vibration-proof support part is provided on another side of the battery unit in the front and back direction.

In the construction machine according to another aspect of the present invention, the lower vibration-proof support part is provided in a front end part of the battery unit, and the upper vibration-proof support part is provided in a back end part of the battery unit.

In the construction machine according to another aspect of the present invention, a frame included in the machine body includes a base plate part, pairwise stay parts standing on the base plate part, and a transverse bridge frame part bridged between the pairwise stay parts, and the upper vibration-proof support part is provided for the transverse bridge frame part.

In the construction machine according to another aspect of the present invention, each of the lower vibration-proof support part and the upper vibration-proof support part has a first mount part provided on a frame side of the machine body, a second mount part provided on the battery unit side, a connection shaft part which connects the first mount part and the second mount part in a relatively rotatable manner, and an elastic member interposed between the first mount part and the second mount part via the connection shaft part.

In the construction machine according to another aspect of the present invention, the electric motor is placed below the battery unit in the machine body.

In the construction machine according to another aspect of the present invention, the machine body has a drive part for placing a drive seat, the electric motor and the battery unit are placed below the drive seat, and the pairwise stay parts stand in a back part of the base plate part.

Effect of the Invention

The present invention, in a configuration provided with a battery unit for supplying electric power to an electric motor, can effectively suppress a vibration of the battery unit by a simple and inexpensive configuration.

DESCRIPTION OF EMBODIMENTS

The present invention, in a configuration provided with a battery unit for supplying electric power to an electric motor, devises a configuration of supporting the battery unit in a vibration-proof manner, thereby to seek to efficiently suppress a vibration of the battery unit at a reduced cost and by a simple configuration. A description will hereinafter be made on an embodiment of the present invention with reference to the drawings.

In the embodiment of the present invention, a description will be made on an excavator (shovel) which is a swing work vehicle, as an example of construction machine according to the present invention. However, the construction machine according to the present invention is not limited to the excavator, and is widely applicable to other types of the construction machine such as a bulldozer, a crane work machine, a compact track loader, a skid-steer loader, and a wheel loader.

Figure 1:
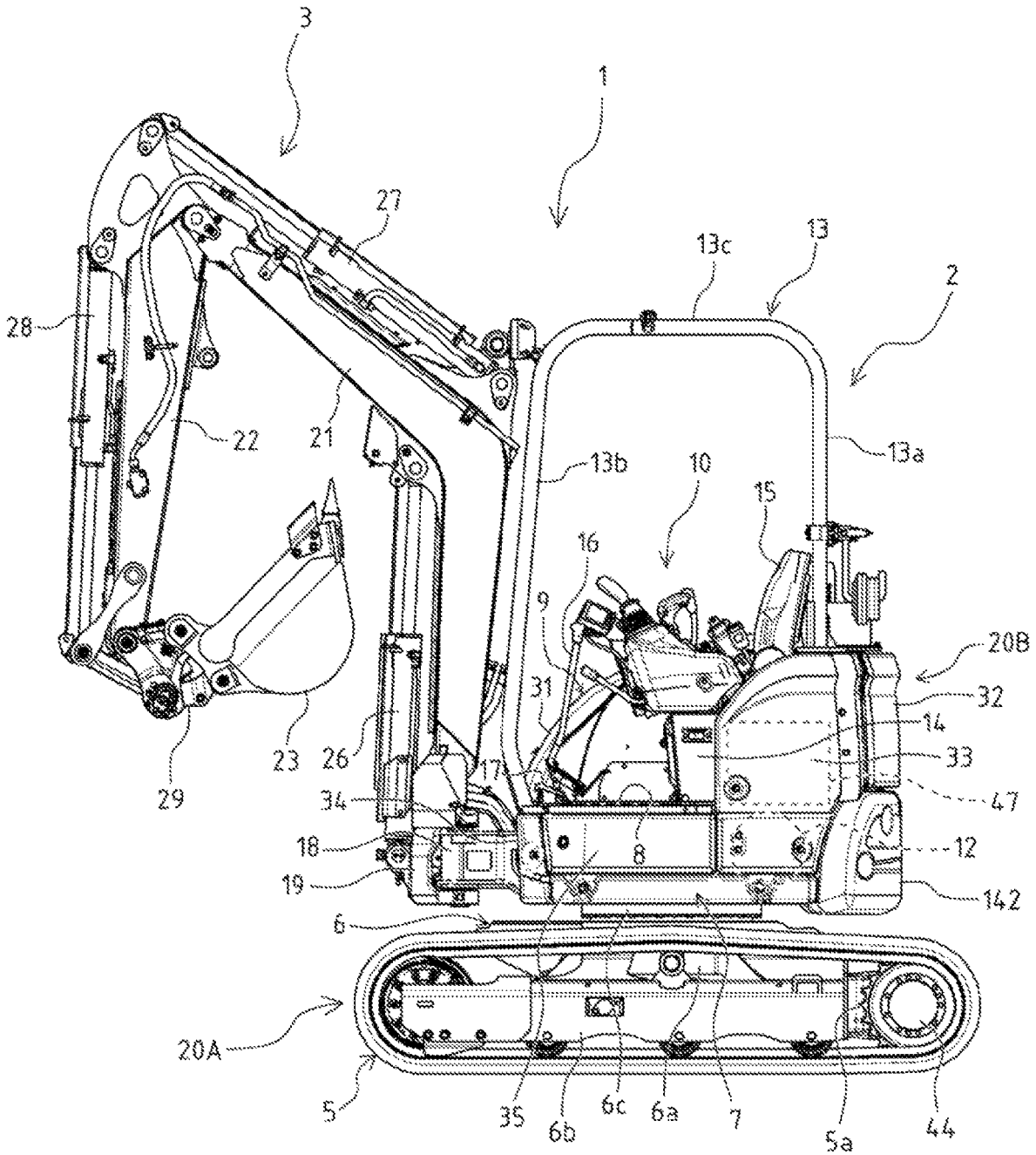
FIG. 1 is a left side view of an excavator according to one embodiment of the present invention.
Figure 2:
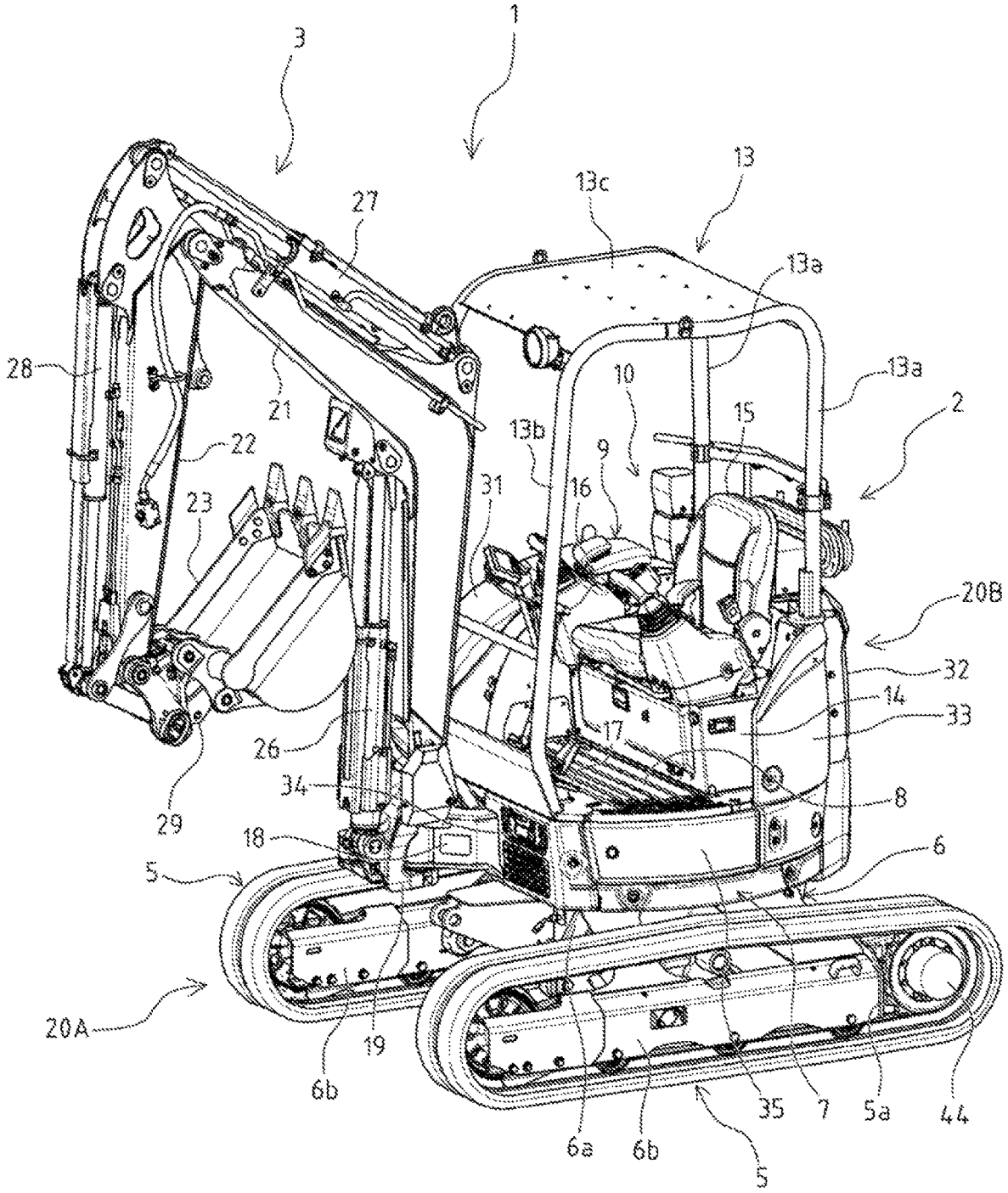
FIG. 2 is a perspective view from the left front of the excavator according to the one embodiment of the present invention.

A description will be made on an overall configuration of the excavator 1 according to the present embodiment with reference to FIGS. 1 and 2. As shown in FIGS. 1 and 2, the excavator 1 includes a run device 2 as a self-propelled run body, and an excavation device 3 as a work part mounted to the run device 2.

The run device 2 is a part constituting a main machine of the excavator 1, and has a pair of right and left crawler-type run parts 5, 5, a truck frame 6 as a base to support the right and left run parts 5, 5, and a swing frame 7 provided on the truck frame 6.

The run part 5 has a configuration in which a crawler is wound around a plurality of rotary bodies such as sprockets supported to a given frame part included in the truck frame 6. The run part 5, in a back end part thereof, has a drive sprocket 5*a* which is a drive wheel. The truck frame 6 has a center frame part 6*a* positioned in the center part between the right and left run parts 5, 5, and side frame parts 6*b* provided on both the right and left sides of the center frame part 6*a*.

The swing frame 7 is configured to be a substantially circular shape in plan view, and is so provided as to be swingable, relative to the truck frame 6, in any of right and left directions around an up/down axial line by a swing support part 6*c* provided on the upper side of the truck frame 6. The swing frame 7 is so configured as to be swingable within the right/left width of the right and left run parts 5, 5, i.e., within the width between the left outer edge of the left run part 5 and the right edge of the right run part 5. This allows for a small swing work by the excavator 1.

On the swing frame 7, there is provided a drive part 10 having a flat floor part 8. The floor part 8 is provided on the left part of the first half part on the swing frame 7. A tank part 9 is provided on the right side of the drive part 10. In the drive part 10, the left side of the floor part 8 is an entry/exit of an operator. Behind the swing frame 7, there is provided, as a drive source, an electric motor 12 which is a prime mover.

The drive part 10 is for driving and operating the run device 2 and the excavation device 3. On the swing frame 7, there is provided a canopy 13 for the drive part 10. The canopy 13 has a pair of right and left back pillar parts 13*a*, 13*a* standing above the prime mover part, a pair of right and left front pillar parts 13*b*, 13*b* standing at the front end part of the floor part 8, and a canopy roof unit 13*c* provided between the front and back pillar parts. The canopy roof unit 13*c* covers the drive part 10 from above.

In the drive part 10; a drive seat support base 14 as a seat mount is provided on the back side of the floor part 8, and a drive seat 15 is provided on the drive seat support base 14. In front of the drive seat 15, there is provided a pair of right and left run levers 16 extending upward from the floor part 8. On both right and left sides of the run lever 16 on the floor part 8, there is placed a plurality of operation pedals 17 for work. In the drive part 10; the drive seat 15 is surrounded by work operation levers for operating the work part such as the excavation device 3, and an operation panel part having various operation parts such as a switch.

The excavator 1 has a lower run body 20A which includes the truck frame 6 and the run parts 5, 5 supported to both the right and left sides of the truck frame 6, and an upper swing body 20B as a machine body so installed as to be swingable relative to the lower run body 20A. The upper swing body 20B includes the swing frame 7 as a frame included in the machine body, and the drive part 10 provided on the swing frame 7. Further, the tank part 9 provided on the right side of the drive part 10 is provided with a hydraulic oil tank 30 that tanks a hydraulic oil (see FIG. 4). The hydraulic oil tank 30 is provided in the front right part of the swing frame 7. The hydraulic oil in the hydraulic oil tank 30 is supplied to hydraulic cylinders and the like provided for the excavator 1, such as hydraulic cylinders and the like included in the excavation device 3.

The hydraulic oil tank 30 is covered with a right cover part 31. The right cover part 31 is a cover part that covers the hydraulic oil tank 30 and a radiator 61 which is provided on the back side thereof, and forms the right side of an exterior cover part that forms an exterior of the upper swing body 20B. The exterior cover part of the upper swing body 20B includes a back cover part 32 forming the back part thereof, a left cover part 33 forming the left portion of the exterior cover part, a front lower cover part 34 covering the lower front part of the upper swing body 20B, and a left front cover part 35 provided below the left end of the floor part 8. The back cover part 32 has its one of right and left sides rotatably supported by a hinge part. The left cover part 33 covers the left side of the drive seat support base 14.

The excavation device 3 is a front work device that is provided on a front side of the run device 2. In the right/left center part at the front end of the swing frame 7, a support bracket 18 to support the excavation device 3 is so provided as to protrude forward. A boom support bracket 19 serves as a base end part of the excavation device 3, with the up/down direction as a rotary axial direction, is rotatably supported to the support bracket 18. The excavation device 3 is so provided as to swing right and left relative to the swing frame 7 by a swing-dedicated hydraulic cylinder (not shown) provided, on the right side of the boom support bracket 19, between the boom support bracket 19 and the swing frame 7.

The excavation device 3 has a boom 21 that has a shape bent in a boomerang shape in side view and that is included in a base part side of the excavation device 3, an arm 22 that is connected to a tip end side of the boom 21, and a bucket 23 that is mounted to a tip end part of the arm 22. The excavation device 3 has a boom cylinder 26 that causes the boom 21 to be rotationally operated, an arm cylinder 27 that causes the arm 22 to be rotationally operated, and a work tool cylinder 28 that causes the bucket 23 to be rotationally operated. These cylinders are each a hydraulic cylinder.

The bucket 23, as a work attachment, is detachably connected via an attachment detachable device 29 to the tip part of the arm 22. In the excavation device 3, another device such as a grapple or a breaker is mounted instead of the bucket 23, depending on the nature of the work.

With the excavator 1 that has the configuration as above, the operator, who is seated on the drive seat 15, by properly operating the run lever 16, the work operation lever or the like, performs a desired operation or work. Specifically, by the operating of the run lever 16, for example, the run device 2 makes the front/back linear run or the right/left swing run. Further, operating of the work operation lever performs the excavating work, etc. by the excavation device 3.

Figure 3:
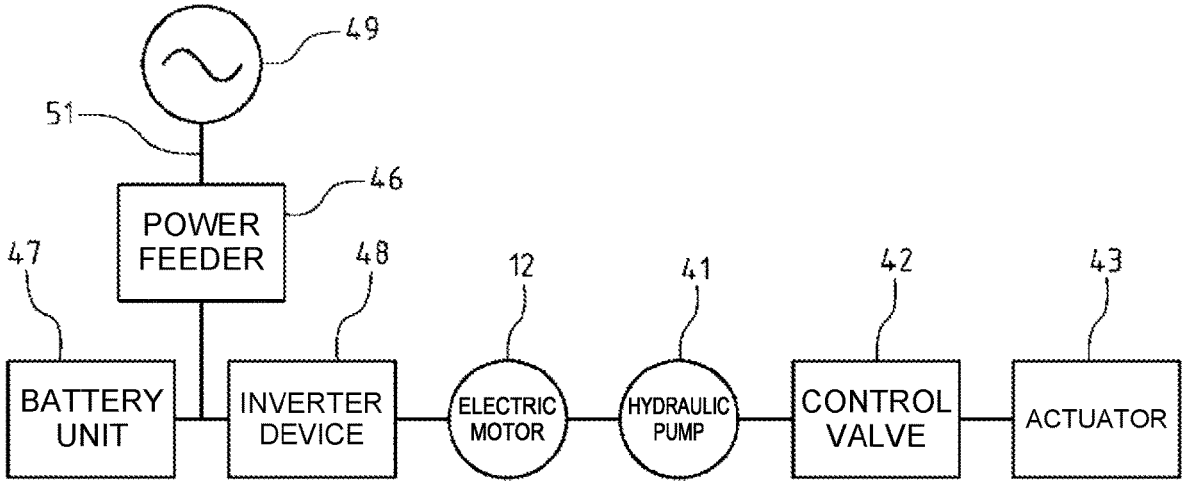
FIG. 3 is a block diagram showing a device configuration provided for the excavator according to the one embodiment of the present invention.

The excavator 1 according to the present embodiment is an electrically-driven construction machine provided with the electric motor 12 as the drive source. As shown in FIG. 3, the electric motor 12 is a pump drive motor that drives a hydraulic pump 41. The electric motor 12 is a three-phase AC motor, for example, and is driven by a supply of AC power. The hydraulic pump 41 is driven by the electric motor 12, thereby to supply, via a control valve 42 to an actuator 43, the hydraulic oil in the hydraulic oil tank 30.

The actuator 43 is a generic term of various hydraulic actuators provided for the excavator 1. The actuators 43 include, for example, the boom cylinder 26, the arm cylinder 27, the work tool cylinder 28, the swing-dedicated hydraulic cylinder, a turn-dedicated hydraulic cylinder, and the like.

The control valve 42 controls the flow of pressure oil to each hydraulic actuator as the actuator 43. The control valve 42 includes a plurality of direction-switch valves which correspond to respective hydraulic actuators, and, by the operation control, etc. of the direction-switch valves, controls the rate and destination of the pressure oil supplied, by the driving of the hydraulic pump 41, from inside the hydraulic oil tank 30. Controlling the supply of the pressure oil to the actuator 43 performs the operation of the excavation device 3 and the swing operation of the upper swing body 20B, etc.

Figure 4:
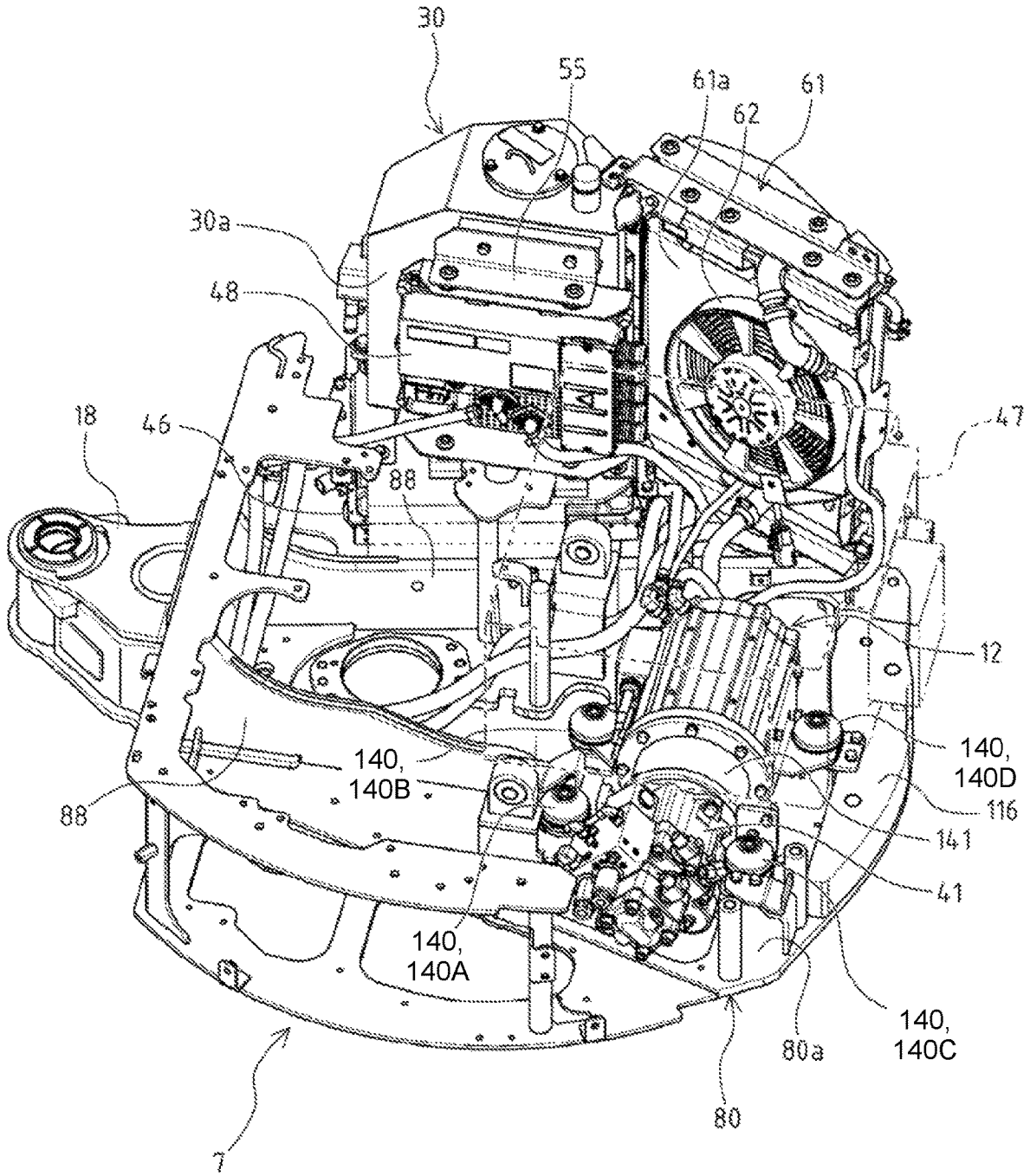
FIG. 4 is a perspective view of one example of a placement mode of the device configuration provided for the excavator according to the one embodiment of the present invention.

As shown in FIG. 4, the electric motor 12, in the back lower part of the swing frame 7, is placed horizontally, with the axial direction of the drive shaft in the right/left direction. The hydraulic pump 41 is provided on the left side of the electric motor 12. The hydraulic pump 41 has its rotary shaft connected via a coupling to the drive shaft of the electric motor 12, and driven following the rotation of the drive shaft of the electric motor 12, thereby to send out the hydraulic oil. The control valve 42 is provided in a given position on the swing frame 7 (e.g., at the left side of the front part of the swing frame 7) in the upper swing body 20B.

Further, the excavator 1 has a pair of right and left run-dedicated hydraulic motors 44, 44 (see FIGS. 1 and 2). The run-dedicated hydraulic motor 44 is driven by receiving a supply of the pressure oil from the control valve 42, and, in each run part 5, is so provided as to rotate and drive the drive sprocket 5*a* while being mounted to a given site such as the side frame part 6*b* of the truck frame 6. The right and left run-dedicated hydraulic motors 44, 44 each drive the run part 5, thereby to cause the run device 2 to make the linear front/back run and the right/left swing run.

As shown in FIG. 3, as the configuration electrically connected directly or indirectly to the electric motor 12, the excavator 1 has the power feeder 46 to supply the electric power from the outside to the electric motor 12, the battery unit 47 as a battery to supply the electric power to the electric motor 12, and the inverter device 48 to control the electric motor 12.

As shown in FIG. 3, the power feeder 46, by a power supply line 51 for outer electric power supply, is electrically connected to the commercial power source 49 as an outer power source. That is, the power feeder 46, by the power supply line 51, takes in the electric power from the commercial power source 49 as the outer power source. The power supply line 51 includes a cable or the like. Further, the power feeder 46 is electrically connected to each of the battery unit 47 and the inverter device 48.

The power feeder 46 has a function of converting AC power (AC voltage), which is supplied from the commercial power source 49, into DC power (DC voltage) and outputting the converted power to the inverter device 48, a function of converting AC power, which is supplied from the commercial power source 49, into DC power and outputting the converted power to the battery unit 47, and a function of outputting, to the inverter device 48, the DC power from the battery unit 47. The power feeder 46 is so configured as to switch, by switching a mode, the function exerted. The power feeder 46 controls the current and voltage values of the supplied power.

The excavator 1 has the following three power feed modes which can be switched by the operating of a mode switch provided, for example, at the drive part 10. That is, the excavator 1 has a battery power feed mode in which the electric motor 12 is powered by the battery unit 47 only, an outer power feed mode in which the electric motor 12 is powered from the outer commercial power source 49 by the power feeder 46, and a storage mode in which power from the outer commercial power source 49 is stored in the battery unit 47 by the power feeder 46.

The outer power feed mode includes a case where at least one of the followings is performed: charging of the battery unit 47 by the power feed from the commercial power source 49 via the power feeder 46, and power feeding from the battery unit 47 to the electric motor 12. That is, the electric motor 12, in the battery power feed mode, is driven by the power feed from the battery unit 47, and in the outer power feed mode, is driven by the power feed from the commercial power source 49, and, as the case may be, receives, from the battery unit 47, supply of drive power. Further, the electric power supplied from the commercial power source 49 or the battery unit 47, after the voltage being stepped down by a DC/DC converter, is supplied to the electric motor 12, an electric fan 62 (described afterward), etc.

As shown in FIG. 4, the power feeder 46, in the swing frame 7, is placed below the hydraulic oil tank 30, and is so provided as to be supported by a given support member.

The battery unit 47 is the power source provided for the excavator 1. The battery unit 47 is a unitary configuration of multiple battery modules. The battery module includes a secondary battery such as a lead acid battery and a lithium ion battery. The battery unit 47 supplies DC current to the inverter device 48.

Figure 5:
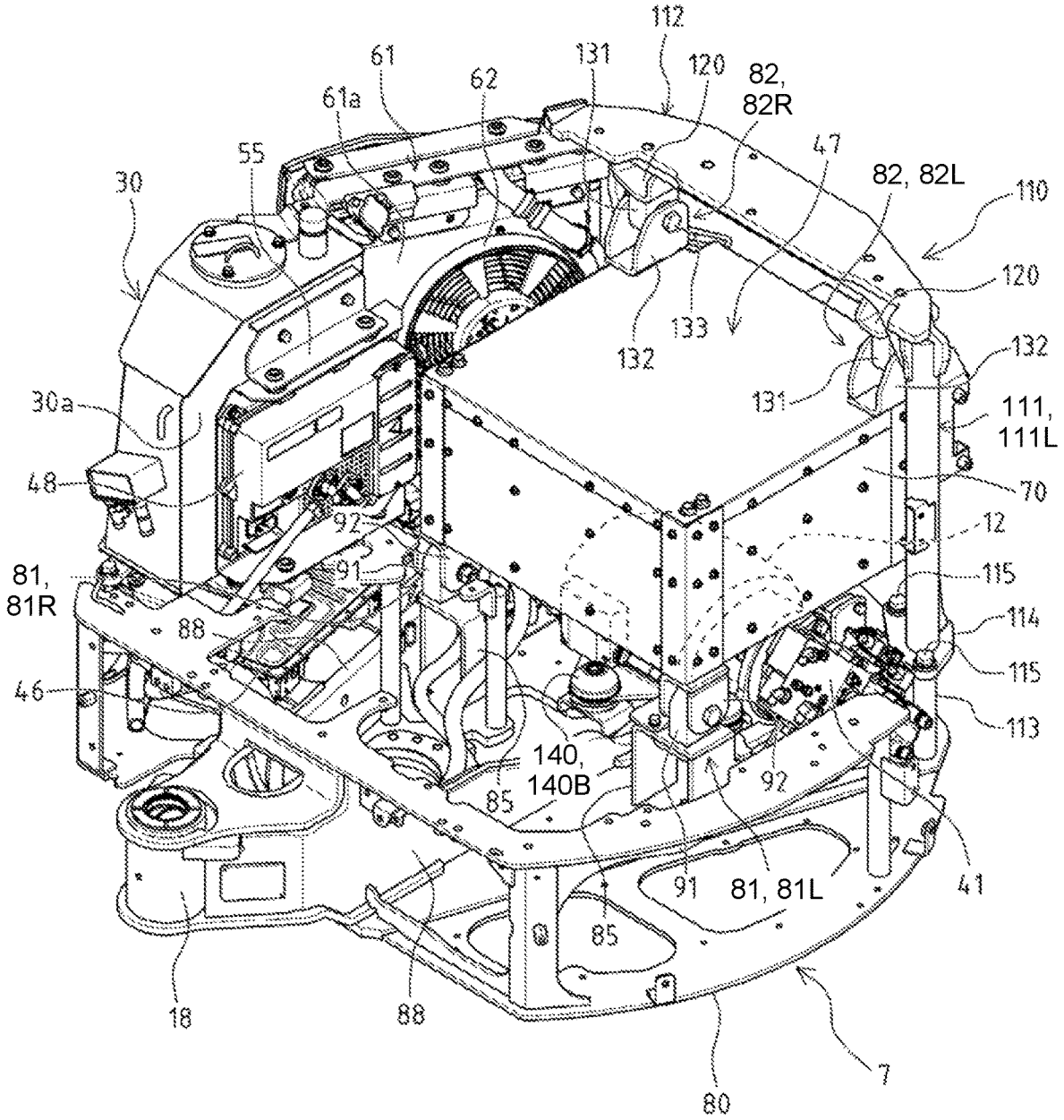
FIG. 5 is a left front perspective view of the one example of the placement mode of the device configuration provided for the excavator according to the one embodiment of the present invention.
Figure 6:
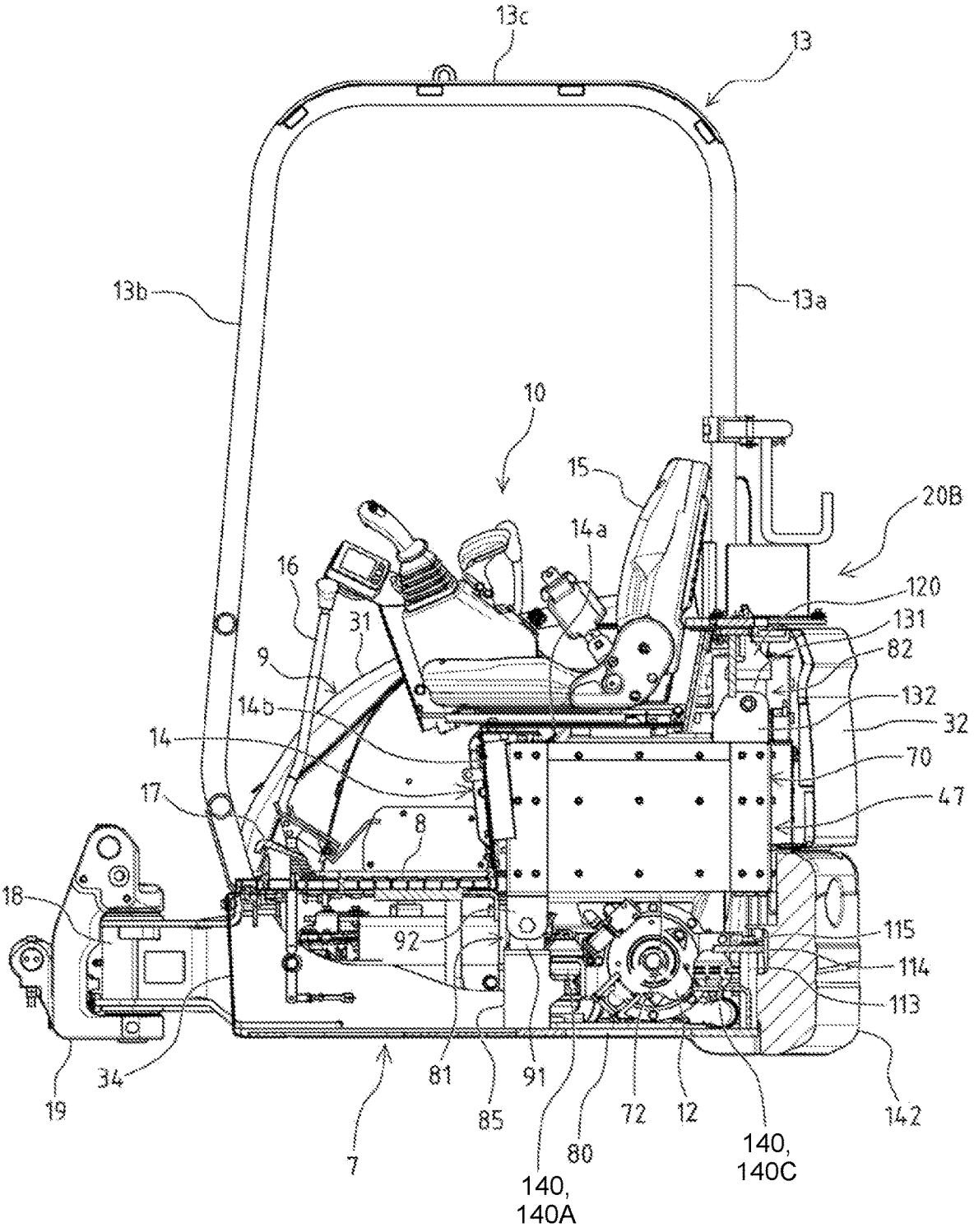
FIG. 6 is a left side face partial cross-sectional view of an upper swing body according to the one embodiment of the present invention.
Figure 7:
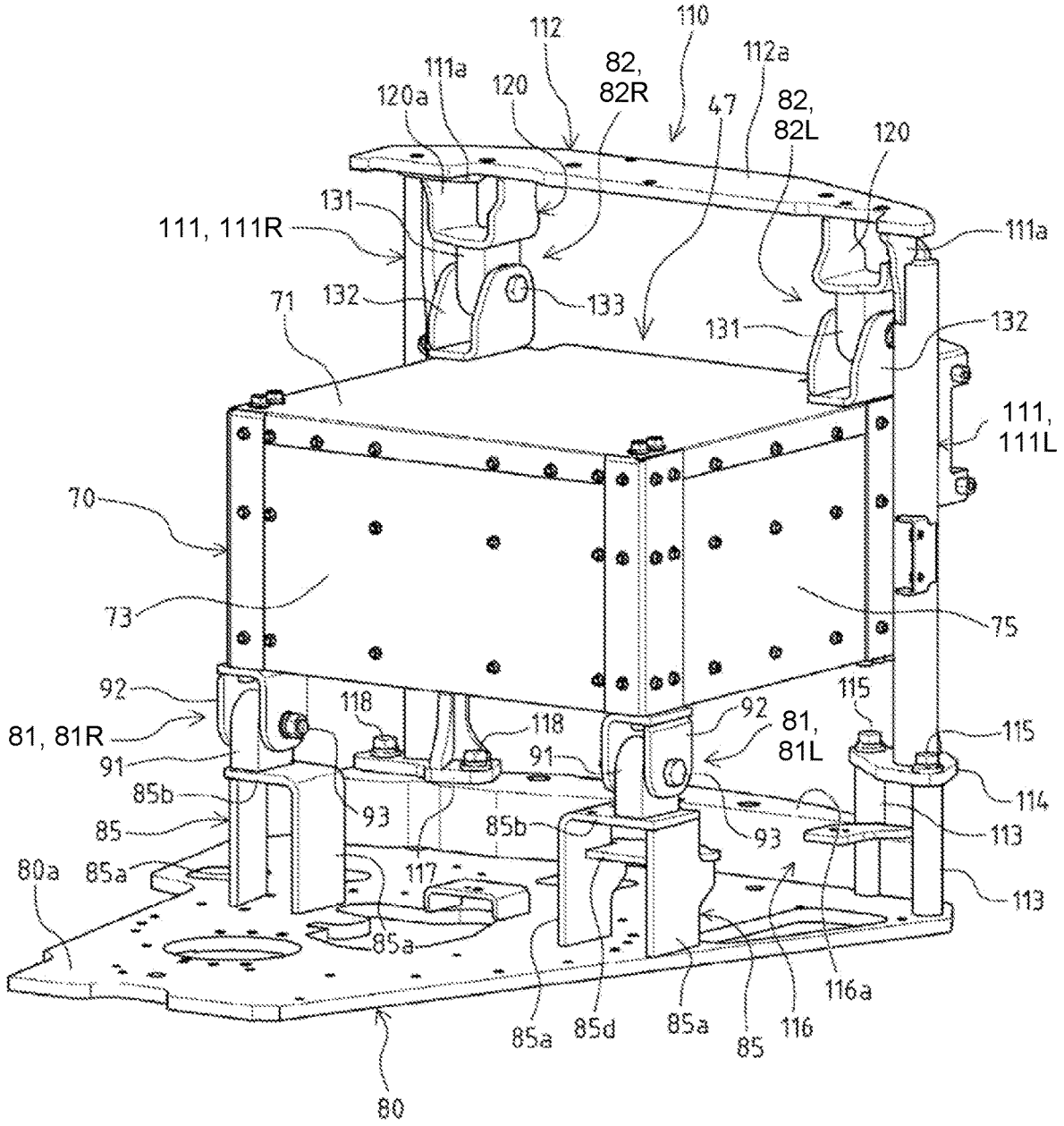
FIG. 7 is a left front perspective view of a support configuration of a battery unit according to the one embodiment of the present invention.
Figure 8:
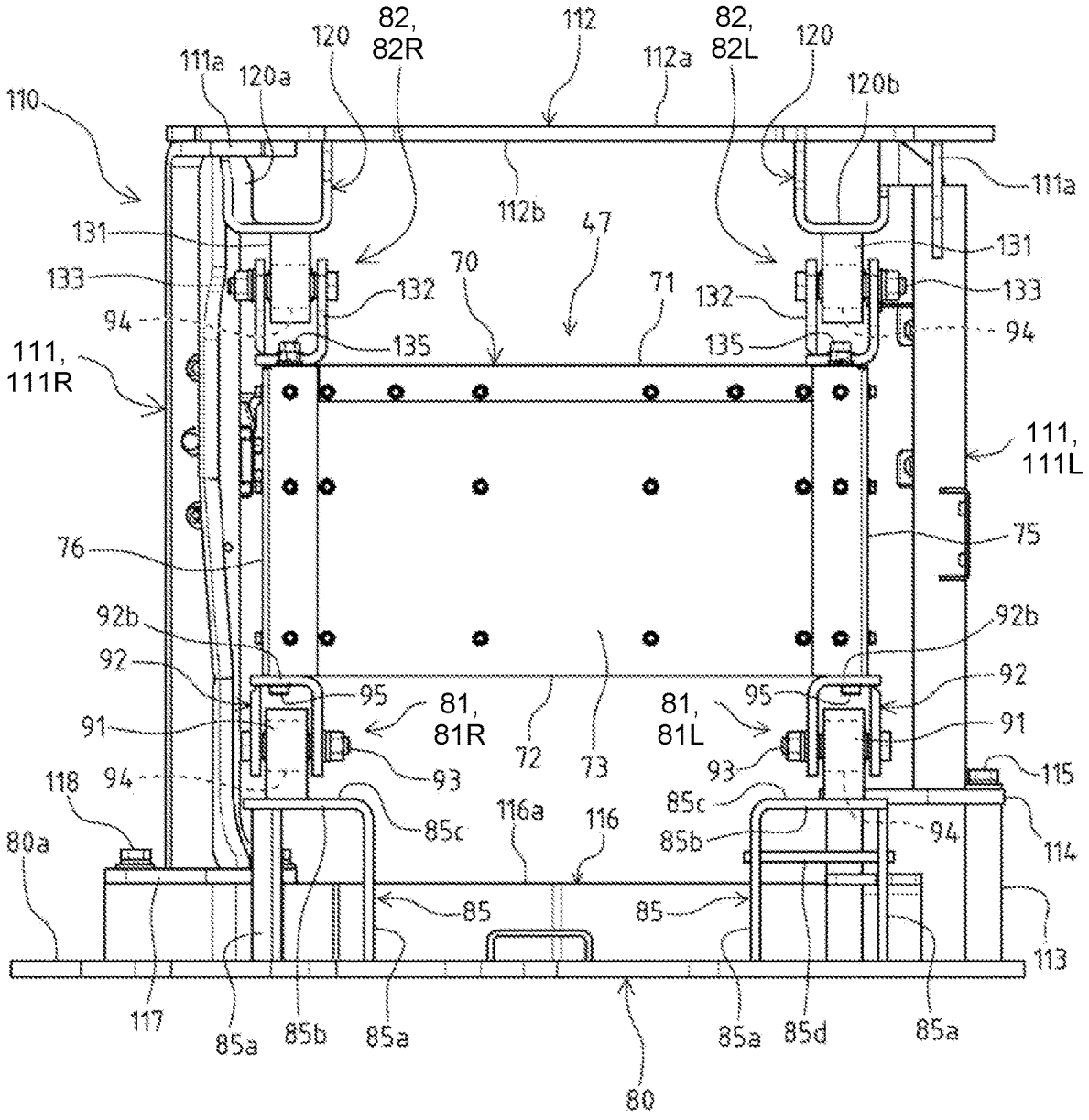
FIG. 8 is a front view of the support configuration of the battery unit according to the one embodiment of the present invention.
Figure 9:
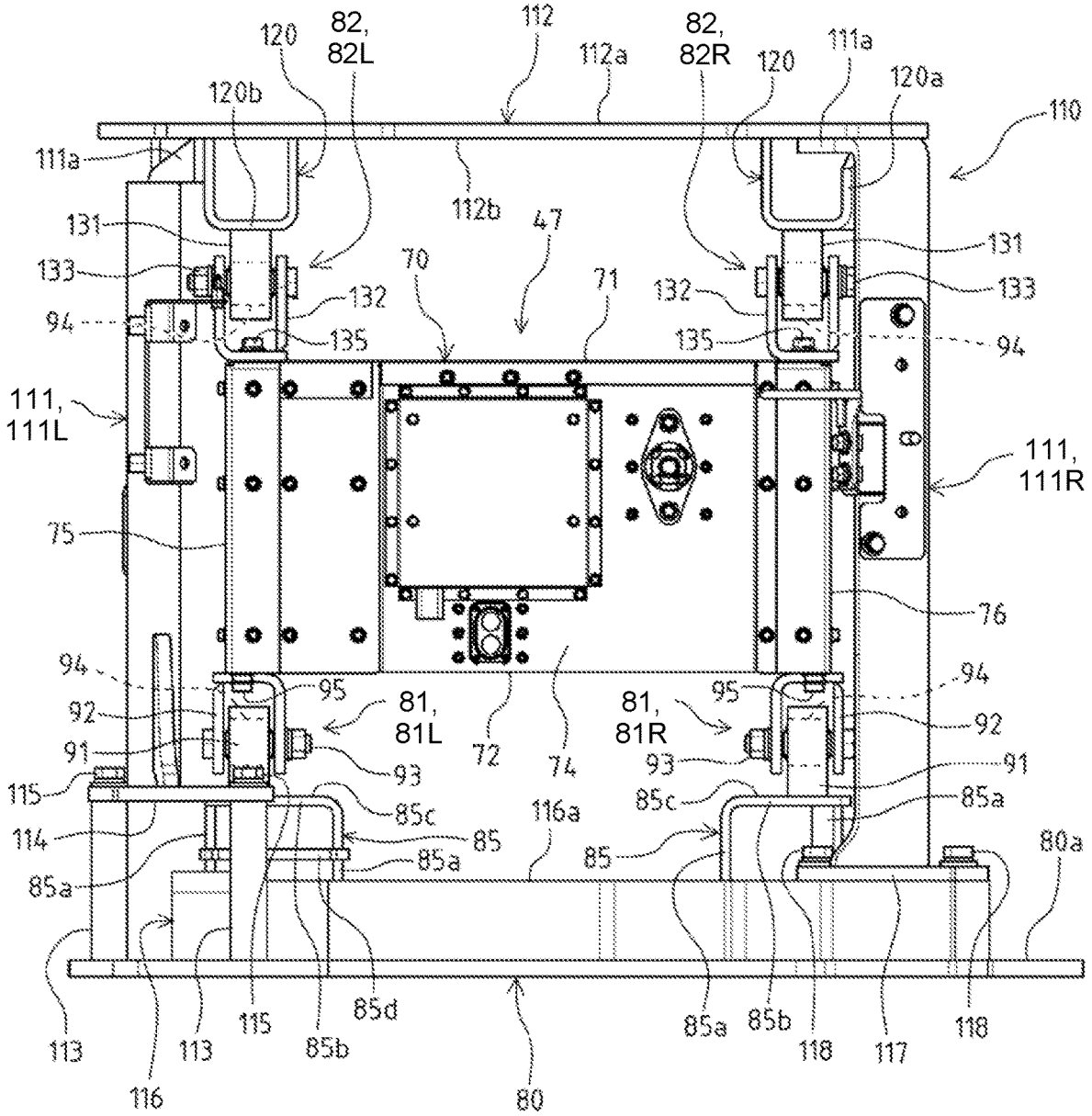
FIG. 9 is a rear view of the support configuration of the battery unit according to the one embodiment of the present invention.

The battery unit 47, in the back part of the swing frame 7, is placed in a position above the electric motor 12, as shown in FIGS. 4, 5 and 6. In FIG. 4, the battery unit 47 is indicated by a double-dashed line for convenience.

The inverter device 48 controls the power output to the electric motor 12, thereby to control the output of the electric motor 12. Specifically, the inverter device 48 converts the DC power, which is supplied from the battery unit 47, into AC power, and supplies the converted power to the electric motor 12. Further, to the electric motor 12, the inverter device 48 supplies, as a given voltage, AC power supplied from the commercial power source 49 via the power feeder 46.

Specifically, the inverter device 48 has an inverter circuit that generates AC power from DC power and supplies the generated power to the electric motor 12, an arithmetic control unit that controls the inverter circuit, and a rectifier circuit that converts the AC power, which is supplied from the commercial power source 49 via the power feeder 46, into DC power and boosts the converted power, and that outputs the boosted power to the inverter circuit. The arithmetic control unit includes a microcomputer, for example.

In the outer power feed mode, the inverter device 48, by the rectifier circuit, converts the AC power, which is supplied from the commercial power source 49 via the power feeder 46, into DC power, and outputs the converted power to the inverter circuit, then generates AC power by the inverter circuit and supplies the generated power to the electric motor 12. Meanwhile, in the battery power feed mode, the inverter device 48, by the inverter circuit, receives the input of DC power supplied from the battery unit 47, then generates AC power by the inverter circuit and supplies the generated power to the electric motor 12.

As shown in FIG. 4, the inverter device 48 is provided right/left inside (left side) the hydraulic oil tank 30 provided in the front part on the right side of the swing frame 7, i.e., on the swing center side of the upper swing body 20B. The inverter device 48 has a substantially rectangular thick plate outline, and, in a state of being along a left side face part 30*a* of the hydraulic oil tank 30, is so provided as to be supported by a given support member 55 to the left side face part 30*a*.

As shown in FIG. 4, the excavator 1 includes the radiator 61, as a cooling system, that cools the cool water supplied to the electric motor 12, the inverter device 48, the power feeder 46, etc. The radiator 61 is a heat exchanger for cooling various devices, and cools the cool water circulating in a specified cool flow path. An electric fan 62 is provided for the radiator 61. In the radiator 61, a communication part for air passage is formed, and air blown by the electric fan 62 passes through the communication part, thereby cooling the cool water.

As shown in FIG. 4, the radiator 61 has a substantially rectangular thick plate outline, and is standing on the right side in the back part of the swing frame 7. The radiator 61, in plan view, is provided in a shape inclined, relative to the front/back direction, in a direction of positioning the back side right/left inside, in such a manner as to be along the outline of the swing frame 7 which is substantially circular. In a side face part 61*a* inside the radiator 61, the electric fan 62 is so integrated with the radiator 61 as to cover most of the side face part 61*a*. The electric fan 62 is driven by electric power supplied from the commercial power source 49 or the battery unit 47.

The battery unit 47 and its support configuration are to be described using FIGS. 5 to 13. As shown in FIGS. 5 to 10, the battery unit 47 has a cuboid-shaped battery body part 70, and, in the back part of the swing frame 7, is so provided as to position the battery body part 70 above the electric motor 12.

The battery unit 47 is so provided that the front, back, left, and right faces of the battery body part 70 face the front, back, and left of the upper swing body 20B. The battery body part 70 has an upper face part 71, a lower face part 72, a front face part 73, a back face part 74, a left side face part 75, and a right side face part 76, each of which is a flat face part. The battery unit 47, in the upper swing body 20B, is so placed that the front face part 73 and back face part 74 of the battery body part 70 are vertical face parts along the right/left direction, and the left side face part 75 and right face part 76 of the battery body part 70 are vertical face parts along the front and back direction.

On the base plate part 80 included in the swing frame 7, the battery unit 47 is supported via a given support member. The base plate part 80 is a part that forms the bottom face portion of the swing frame 7, and includes a horizontally placed plate-shaped frame member and the like. The base plate part 80 has a flat upper face 80*a*. On the base plate part 80, there is provided a pair of right and left longitudinal plates 88 placed along in a substantially front/back direction from the back side of the support bracket 18 provided in the right/left center part on the front side of the swing frame 7. The longitudinal plate 88 is fixed to the base plate part 80, forming a part of the swing frame 7.

The right longitudinal plate 88, about the back side, extends to the back end part of the swing frame 7, defining a position for placing the electric motor 12 and radiator 61. The left longitudinal plate 88, about the back side, extends to the vicinity on the front side of the electric motor 12, and the control valve 42 is placed on the left side of the left longitudinal plate 88. The right and left longitudinal plates 88 cause the front part to extend forward from the front lower cover part 34, forming the right and left side face parts of the support bracket 18.

The battery unit 47 is supported in a vibration-proof manner to the upper swing body 20B where the battery unit 47 is installed. To the base plate part 80 of the swing frame 7, the battery unit 47 is supported by a lower vibration-proof support part 81 that supports the lower side of the battery unit 47 in a vibration-proof manner, and an upper vibration-proof support part 82 that supports the upper side of the battery unit 47 in a vibration-proof manner. The lower vibration-proof support part 81 is provided for the lower face part 72 of the battery body part 70, and the upper vibration-proof support part 82 is provided for the upper face part 71 of the battery body part 70. The lower vibration-proof support part 81 is provided on the front side of the battery unit 47, and the upper vibration-proof support part 82 is provided on the back side of the battery unit 47.

In the present embodiment, each of the lower vibration-proof support parts 81 and the upper vibration-proof support parts 82 are provided at both the right and left ends of the battery body part 70. Further, the lower vibration-proof support part 81 is provided in the front end part of the battery unit 47, and the upper vibration-proof support part 82 is provided in the back end part of the battery unit 47.

Thus, as the lower vibration-proof support parts 81, a left lower vibration-proof support part 81L and a right lower vibration-proof support part 81R which are positioned on the lower side of the respective apex parts on the left and right sides on the front lower side of the battery body part 70 are provided. Further, as the upper vibration-proof support parts 82, a left upper vibration-proof support part 82L and a right upper vibration-proof support part 82R which are positioned on the upper side of the respective apex parts on the left and right sides on the back upper side of the battery body part 70 are provided.

Thus, the battery unit 47 is supported in a vibration-proof manner (elastically supported) to the base plate part 80 of the swing frame 7 in four places including the left lower vibration-proof support part 81L, the right lower vibration-proof support part 81R, the left upper vibration-proof support part 82L and the right upper vibration-proof support part 82R. The left and right lower vibration-proof support parts 81 and the left and right upper vibration-proof support parts 82 are each configured to be left/right symmetrical or left/right substantially symmetrical.

The battery unit 47, by the vibration-proof support parts in four places, is supported to the base plate part 80 in a state where the battery body part 70 is positioned at a given height. Specifically, a distance D1 between the upper face 80*a* of the base plate part 80 and the lower face part 72 of the battery body part 70 has a dimension substantially the same as an up/down dimension D2 of the battery body part 70 (see FIG. 10).

The following describes the lower vibration-proof support part 81. To the base plate part 80, the lower vibration-proof support part 81 is provided on a support leg part 85 provided on the upper face 80*a*. That is, to the upper face 80*a* of the base plate part 80, the front side of the battery body part 70 is supported by the lower vibration-proof support part 81 via the support leg part 85 provided on the upper face 80*a*.

The support leg part 85 has a pair of right and left side wall parts 85*a* facing each other and a support face part 85*b* provided between the upper end parts of the right and left side wall parts 85*a*, and is configured in a gate shape by these face parts. The side wall part 85*a* is a plate-shape part provided perpendicular to the upper face 80*a*, and the support face part 85*b* is a plate-shape part provided parallel to the base plate part 80. The support face part 85*b*, together with the right/left inside wall part 85*a*, is formed by an integrated substantially "L" plate-shape member formed to be bent at a right angle.

The support leg part 85 has a horizontal upper face 85*c* of the support face part 85*b* as a face for supporting the lower vibration-proof support part 81. The support leg parts 85 fix the lower ends of the right and left side wall parts 85*a* to the upper face 80*a* of the base plate part 80 by welding or the like, thereby to be fixed to the base plate part 80 side. Further, in the left support leg part 85 of the right and left support leg parts 85, a plate member 85*d* parallel to the support face part 85*b* is bridged between the upper parts of the right and left side wall parts 85*a*.

Figure 11:
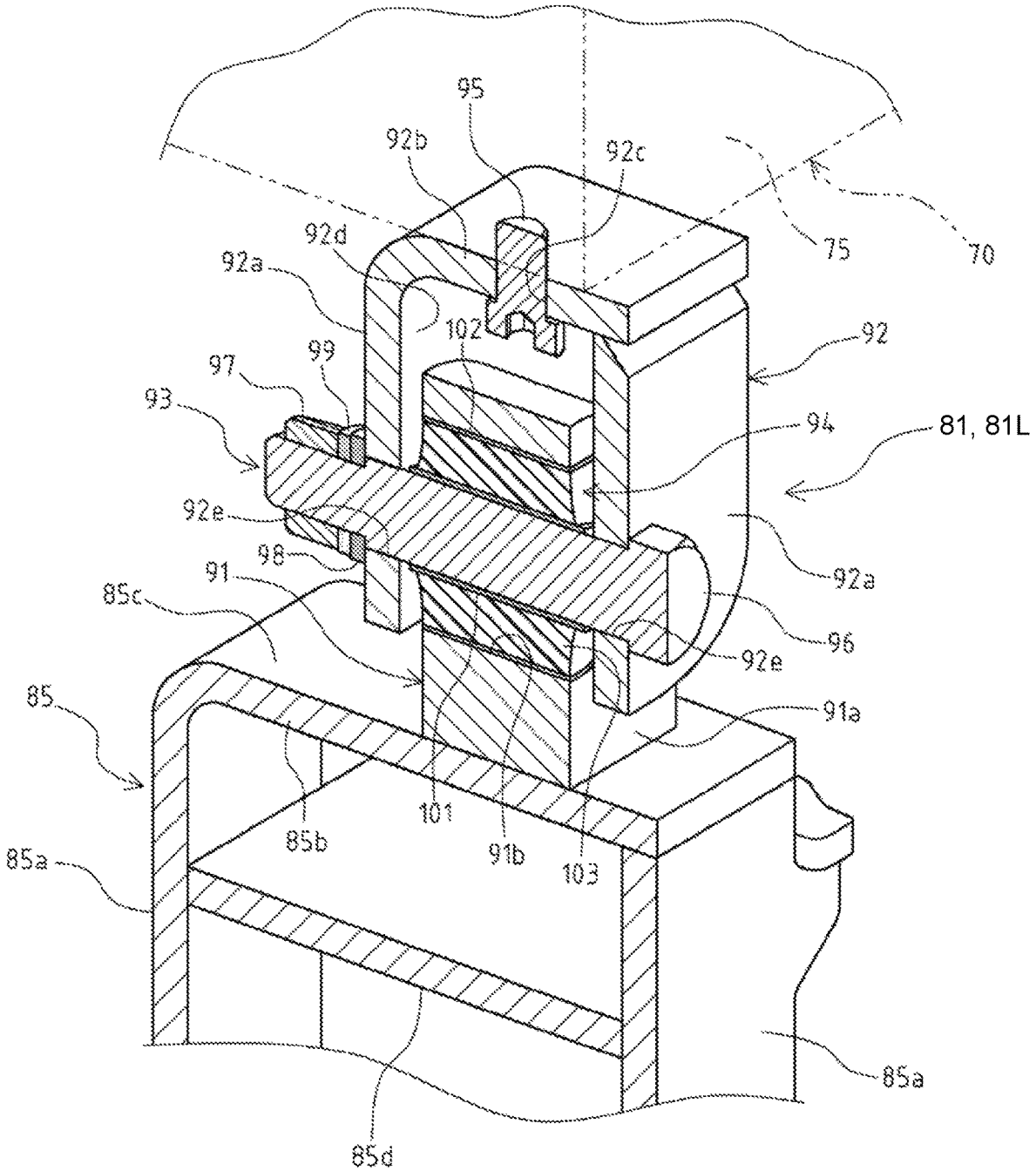
FIG. 11 is a longitudinal cross-sectional perspective view of a configuration of a lower vibration-proof support part according to the one embodiment of the present invention.

As shown in FIG. 11, the lower vibration-proof support part 81 has a lower boss part 91 which is a first mount part provided on the swing frame 7 side, a lower bracket part 92 which is a second mount part provided on the battery unit 47 side, a connection shaft part 93 that connects the lower boss part 91 and the lower bracket part 92 in a relatively rotatable manner, and an elastic member 94 interposed between the lower boss part 91 and lower bracket part 92 via the connection shaft part 93.

The lower boss part 91 is provided on the support leg part 85 provided on the upper face 80*a* of the base plate part 80 that is included in the swing frame 7. That is, the lower boss part 91 is provided via the support leg part 85 to the base plate part 80, thereby to be provided on the swing frame 7 side. The lower boss part 91 is so provided as to be fixed to the upper face 85*c* of the support leg part 85, and is provided as an upward protrusion part from the upper face 85*c*.

As shown in FIG. 11, the lower boss part 91 has right and left side faces 91*a* which are flat faces, and also has, about the upper part, a shape along a circular arc shape with the upper side as a convex side in side view. The lower boss part 91 has a support hole part 91*b* for supporting the connection shaft part 93 via the elastic member 94. The support hole part 91*b* is an open part which is formed by a cylindrical inner peripheral face and which passes through the lower boss part 91 right and left, and is so formed as to be along the circular arc shape of the upper part of the lower boss part 91 in side view.

The lower bracket part 92 is a part so provided as to protrude downward from the lower face part 72 of the battery body part 70, and has a pair of right and left side face parts 92*a* facing each other, and a fixed face part 92*b* provided between the upper end parts of the right and left side face parts 92*a*. The side face part 92*a* is a plate-shape part with the right/left direction as the thickness direction, and the fixed face part 92*b* is a plate-shape part with the up/down direction as the thickness direction. Thus, the lower bracket part 92 is a bent plate-shape part that forms a substantially inverted "U" shape in front view by the right and left side face parts 92*a* and the fixed face part 92*b*.

The lower bracket part 92, in a state where the fixed face part 92*b* is along the lower face part 72 of the battery body part 70, is fastened and fixed to the battery body part 70 by a fixing bolt 95 as a fixing member. The fixing bolt 95 passes through the fixed face part 92*b* from the lower side, and is screwed into a female thread part so provided on the battery body part 70 side as to open facing the lower face part 72. A hole part 92*c* for the fixing bolt 95 to pass through is formed in the fixed face part 92*b*.

The lower bracket part 92 has the lower boss part 91 positioned between the right and left side face parts 92*a*. In other words, the lower bracket part 92 has inner side faces 92*d* of the right and left side face parts 92*a* face the right and left side parts 91*a* of the lower boss part 91. The side face part 92*a* is separated from the lower boss part 91 by a gap.

The lower bracket part 92 has the right and left side face parts 92*a*'s lower ends positioned below the support hole part 91*b* of the lower boss part 91. That is, from the right/left outside, the lower bracket part 92, by a lower part thereof, covers a site forming the support hole part 91*a* in the lower boss part 91. Thus, the lower bracket part 92, by the right and left side face parts 92*a* and the fixed face part 92*b*, covers most of the upper side of the lower boss part 91 from the upper side and both right and left sides.

The connection shaft part 93 includes a bolt shaft 96 that passes through the right and left side face parts 92*a* of the lower bracket part 92 and the support hole part 91*b* of the lower boss part 91 between them, and a nut 97 screwed to the tip part of the bolt shaft 96. The bolt shaft 96, with its axial direction as the right/left direction, passes through the lower bracket part 92 and the lower boss part 91 from the right/left outside, and has its tip part protrude from the right/left inside face part 92*a*. Hole parts 92*e* for the bolt shaft 96 to pass through are formed in the right and left side face parts 92*a*. The side face part 92*a*, by the hole part 92*e*, allows the bolt shaft 96 to penetrate in a relatively rotatable manner.

The bolt shaft 96 has a thread part in the tip part, and the nut 97 is screwed onto the thread part. A flat washer 98 and a spring washer 99 through which the bolt shaft 96 passes are interposed between the nut 97 and the right/left inside side face part 92*a*.

Figure 12:
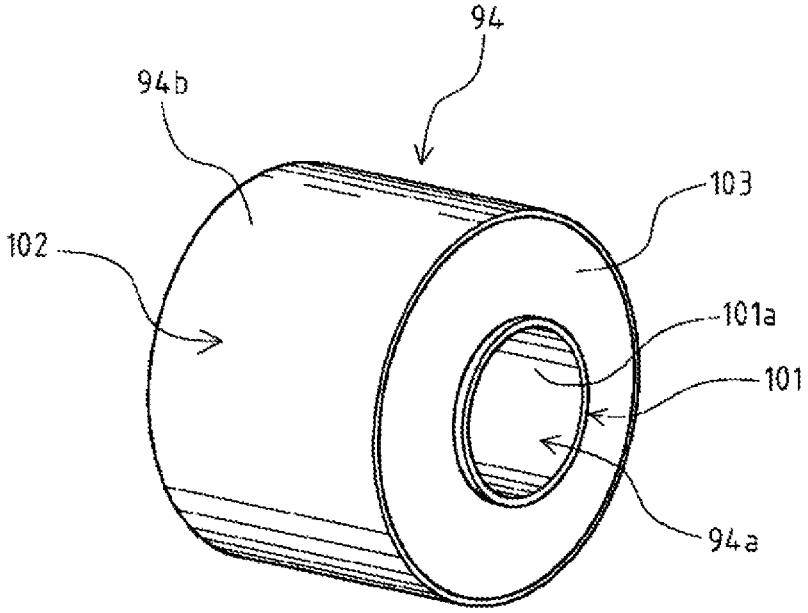
FIG. 12 is a perspective view of a configuration of an elastic member according to the one embodiment of the present invention.

The elastic member 94 is a vibration-proof support-dedicated bush having a cylindrical outline, as shown in FIG. 12. The elastic member 94 is fitted and fixed to the support hole part 91*b* of the lower boss part 91 by a press fit or the like with the central axial direction (cylinder axial direction) as the right/left direction, and is provided in a state where the bolt shaft 96 passes therethrough. The elastic member 94 has an inner pipe 101 and an outer pipe 102 concentrically placed each other, and an elastic part 103 provided between these pipes.

The inner pipe 101 and the outer pipe 102 are each a metal pipe formed from metallic materials such as iron and stainless steel. The central axial lengths of the inner pipe 101 and outer pipe 102 are substantially the same as each other, and the inner pipe 101, on both end sides thereof, protrudes slightly outward from the end face of the outer pipe 102.

The elastic part 103 is a part which is so formed, by an elastic material such as rubber material including a natural rubber and a nitrile rubber, as to fill a space between the inner pipe 101 and the outer pipe 102. That is, the elastic part 103 is interposed between the outer peripheral side of the inner pipe 101 and the inner peripheral side of the outer pipe 102, and causes the inner peripheral side to adhere to substantially the entirety of the outer peripheral face of the inner pipe 101 and cause the outer peripheral side to adhere to substantially the entirety of the inner peripheral face of the outer pipe 102. The elastic part 103, as a cylindrical rubber part, integrates the inner pipe 101 with the outer pipe 102.

The elastic member 94, by the inner peripheral face 101*a* of the inner pipe 101, forms a support hole part 94*a* for the bolt shaft 96 to pass through. The support hole part 94*a* has an outer diameter that is substantially the same as the outer diameter of the middle part of the bolt shaft 96, and allows the bolt shaft 96 to be inserted in a relatively rotatable manner. Further, the elastic member 94 has the outer peripheral face 94*b*, which is formed by the outer pipe 102, as a face contacting the support hole part 91*b* of the lower boss part 91. Thus, the elastic member 94 is interposed between the lower boss part 91 and the lower bracket part 92 via the bolt shaft 96 of the connection shaft part 93.

The lower vibration-proof support part 81 provided with the above configuration elastically supports the lower bracket part 92 in a relatively rotatable manner via the elastic member 94 to the lower boss part 91, by the bolt shaft 96 passing through the elastic member 94 provided in the lower boss part 91. The lower vibration-proof support part 81 receives a load from the battery body part 70 via the lower bracket part 92 and bolt shaft 96 on the elastic member 94, thereby to obtain, for the lower boss part 91, an elastic action together with radial compression of the elastic part 103 of the elastic member 94.

The following describes the upper vibration-proof support part 82. To the base plate part 80, the upper vibration-proof support part 82 is provided to a gate-shaped frame part 110 which is configured in substantially a gate. The gate-shaped frame part 110 includes a pair of right and left stay parts 111 standing on the base plate part 80 and a transverse bridge frame part 112 bridged between the right and left stay parts 111.

The stay part 111 is a linear pillar part along the up/down direction. The right and left stay parts 111, so that the battery body part 70 is positioned between each other, are provided in positions at an interval which is, about the right/left direction, longer than the right/left dimension of the battery body part 70. The back part of the battery body part 70 is positioned between the right and left stay parts 111 (see FIG. 10). Regarding the right and left stay parts 111, the left stay part 111L is provided in the position near the left side of the left side face part 75 of the battery body part 70, and the right stay part 111R is provided in the position near the right side of the right side face part 76 of the battery body part 70.

The right and left stay parts 111 cause their upper parts to extend above the upper face part 71 of the battery body part 70, and cause their lower parts to extend below the lower face part 72 of the battery body part 70. That is, the battery body part 70, about the up/down direction, is positioned in the middle part of the stay part 111.

To the base plate part 80, the left stay part 111L is supported via two support pillars 113 standing on the upper face 80*a*. One of the support pillars 113 is positioned on the left front side relative to the stay part 111L, and the other of the support pillars 113 is positioned on the right back side relative to the stay part 111L. The support pillar 113 is fixed by a bolt 115 which is screwed into the support pillar 113 from the upper side through a plate-shape flange part 114 provided in the lower end part of the stay part 111L. The support pillar 113 is fixed to the base plate part 80 by welding or the like.

The right stay part 111R is provided in a state of being fixed to on a support base part 116 so provided as to be along the back edge part of the base plate part 80. The support base part 116 is used as a part for mounting a counterweight 142 (see FIG. 1) which is provided on the lower side of the back cover part 32 in the upper swing body 20B.

The support base part 116 is a hollow protrusion part so provided as to form a step part relative to the upper face 80*a* of the base plate part 80, and has a flat upper face 116*a*. The stay part 111R stands on the right end part of the support base part 116. The stay part 111R, at its lower end part, has a plate-shape flange part 117, and, in a state where the flange part 117 overlaps the right end part of the upper face 116*a* of the support base part 116, is fixed by a bolt 118 that is screwed from the upper side through the flange part 117 into the support base part 116.

The transverse bridge frame part 112 is bridged between the upper end parts of the right and left stay parts 111. The transverse bridge frame part 112 is formed by a longitudinal plate-shape member with the right/left direction as the longitudinal direction, and define the up/down direction as the thickness direction. The transverse bridge frame part 112 has an upper face 112*a* and a lower face 112*b*, each of which is a horizontal flat face.

The upper end parts of the right and left stay parts 111 each are formed with a plate support part 111*a* having a given shape for supporting the transverse bridge frame part 112. The transverse bridge frame part 112 has the right and left end parts thereof fixed to the plate support parts 111*a* of the stay part 111 by welding or the like, thereby to be fixed to each of the stay parts 111. As a result, the transverse bridge frame part 112 is so provided as to be horizontally supported on the upper side of the right and left stay parts 111, forming, in combination with the right and left stay parts 111, the gate-shaped frame part 110.

Thus, regarding the support configuration of the upper vibration-proof support part 82, the swing frame 7 includes the base plate part 80, a pair of stay parts 111 standing on the base plate part 80, and the transverse bridge frame part 112 suspended between the pairwise stay parts 111. Then, the upper vibration-proof support part 82 is provided for the transverse bridge frame part 112.

For the transverse bridge frame part 112, the upper vibration-proof support part 82 is provided on a support protrusion part 120 provided on the lower face 112*b* of the transverse bridge frame part 112. That is, to the upper face 80*a* of the base plate part 80, the back side of the battery body part 70 is supported by the upper vibration-proof support part 82 via the gate-shaped frame part 110 and the support protrusion part 120 which are provided above the upper face 80*a*.

The support protrusion part 120 has a pair of right and left side wall parts 120*a* facing each other, and a support face part 120*b* provided between the lower end parts of the right and left side wall parts 120*a*, and is configured in a substantially "U" shape by these face parts. The side wall part 120*a* is a plate-shape part provided perpendicular to the lower face 112*b* of the transverse bridge frame part 112, and the support face part 112*b* is a plate-shape part provided parallel to the base plate part 80. The side wall parts 120*a* and the support face part 120*b* are formed by an integrated "U"-shaped plate member formed to be bent at a right angle.

The support protrusion part 120 has a horizontal lower face part 120*c* of the support face part 120*b* as the support face of the upper vibration-proof support part 82. The support protrusion part 120 has the upper ends of the right and left side wall parts 120*a* fixed to the lower face 112*b* of the transverse bridge frame part 112 by welding or the like, thereby to be fixed to the transverse bridge frame part 112 side. Further, of the right and left support protrusion parts 120, the right side support protrusion part 120 has the upper end of the outer side wall part 120*a* fixed by welding or the like to the plate-shape part that is formed to be bent as the plate support part 111*a* in the upper end part of the stay part 111R and that is along the transverse bridge frame part 112.

Figure 13:
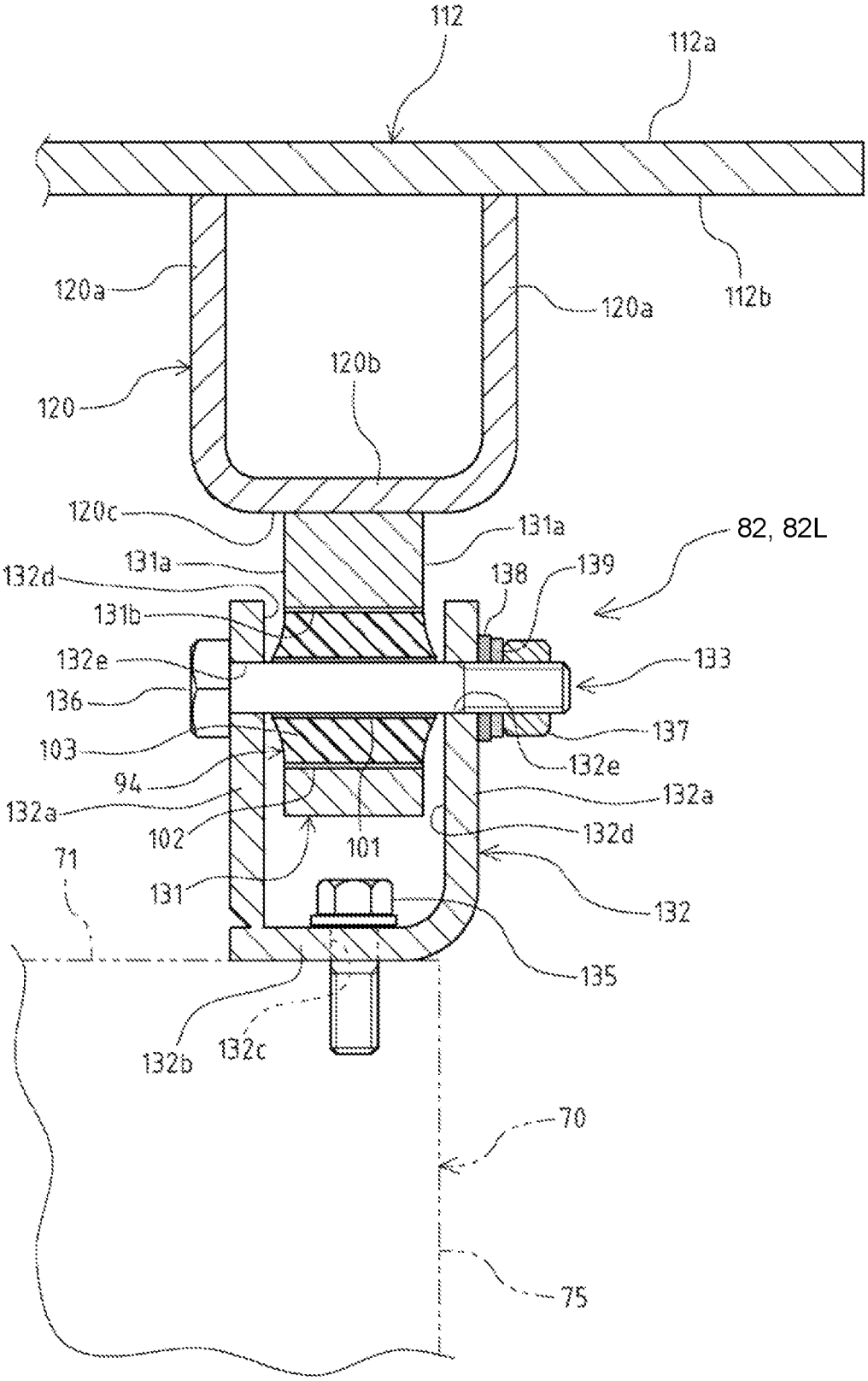
FIG. 13 is a front longitudinal cross-sectional view of a configuration of an upper vibration-proof support part member according to the one embodiment of the present invention.

The upper vibration-proof support part 82 is so configured as to be up/down symmetrical with the lower vibration-proof support part 81, and is similar in configuration to the lower vibration-proof support part 81. As shown in FIG. 13, the upper vibration-proof support part 82 has an upper boss part 131 which is a first mount part provided on the swing frame 7 side, an upper bracket part 132 which is a second mount part provided on the battery unit 47 side, a connection shaft part 133 which connects the upper boss part 131 and the upper bracket part 132 in a relatively rotatable manner, and an elastic member 94 interposed between the upper boss part 131 and the upper bracket part 132 via the connection shaft part 133.

The upper boss part 131 is provided on the support protrusion part 120 so provided as to be fixed to the gate-shaped frame part 110 which stands on the upper face 80*a* of the base plate part 80 included in the swing frame 7. That is, the upper boss part 131 is provided via the gate-shaped frame part 110 and the support protrusion part 120 to the base plate part 80, thereby to be provided on the swing frame 7 side. The upper boss part 131 is fixed to the lower face part 120*c* of the support protrusion part 120, and is provided as a part protruding downward from the lower face part 120*c*.

The upper boss part 131 has right and left sides 131*a* which are flat faces, as shown in FIG. 13, and also, about the lower part, has a shape along a circular arc shape with the lower side as a convex side in side view. The upper boss part 131 has a support hole part 131*b* for supporting the connection shaft part 133 via the elastic member 134. The support hole part 131*b* is an open part which is formed by a cylindrical inner peripheral face and which passes through the upper boss part 131 right and left, and is so formed as to follow the circular arc shape of the upper part of the upper boss part 131 in side view.

The upper bracket part 132 is a part so provided as to protrude upward from the upper face part 71 of the battery body part 70, and has a pair of right and left side face parts 132*a* facing each other in the right/left direction, and a fixed face part 132*b* provided between the lower end parts of the right and left side face parts 132*a*. The side face part 132*a* is a plate-shape part with the right/left direction as the thickness direction, and the fixed face part 132*b* is a plate-shape part with the up/down direction as the thickness direction. Thus, the upper bracket part 132 is a bent plate-shape part that forms a substantially "U" shape in front view by the right and left side face parts 132*a* and the fixed face part 132*b*.

The upper bracket part 132, in a state where the fixed face part 132*b* is along the upper face part 71 of the battery body part 70, is fastened and fixed to the battery body part 70 by a fixing bolt 135 as a fixing member. The fixing bolt 135 passes through the fixed face part 132*b* from the upper side, and is screwed into a female thread part so provided on the battery body part 70 side as to open facing the upper face part 71. A hole part 132*c* for the fixing bolt 135 to pass through is formed in the fixed face part 132*b*. The upper bracket part 132 has the upper boss part 131 positioned between the right and left side face parts 132*a*. In other words, the upper bracket part 132 has the inside faces 132*d* of the right and left side face parts 132*a* facing the right and left side face parts 131*a* of the upper boss part 131. The side face part 132*a* is separated from the upper boss part 131 by a gap.

The upper bracket part 132 has the upper ends of the right and left side face parts 132*a* positioned above the support hole parts 131*b* of the upper boss part 131. That is, from the right/left outside, the upper bracket part 132, by an upper part thereof, covers a site forming the support hole part 131*a* in the upper boss part 131. Thus, the upper bracket part 132, by the right and left side face parts 132*a* and the fixed face part 132*b*, covers most of the upper side of the upper boss part 131 from the lower side and both right and left sides.

The connection shaft part 133 includes a bolt shaft 136 that passes through the right and left side face parts 132*a* of the upper bracket part 132 and the support hole part 131*b* of the upper boss part 131 between them, and a nut 137 screwed to the tip part of the bolt shaft 136. The bolt shaft 136, with its axial direction as the right/left direction, passes through the upper bracket part 132 and the upper boss part 131 from the right/left inside, and has its tip part protrude from the right/left outside side face part 132*a*. Hole parts 132*e* for the bolt shaft 136 to pass through are formed in the right and left side face parts 132*a*. The side face part 132*a* allows the bolt shaft 136 to pass through the hole part 132*e* in a relatively rotatable manner.

The bolt shaft 136 has a thread part in the tip part, and the nut 137 is screwed onto this thread part. A flat washer 138 and a spring washer 139 through which the bolt shaft 136 passes are interposed between the nut 137 and the right/left inside face part 132*a*.

In the upper vibration-proof support part 82, the elastic member 94 is fitted and fixed to the support hole part 131*b* of the upper boss part 131 by a press fit or the like with the central axial direction (cylinder axial direction) as the right/left direction, and is provided in a state where the bolt shaft 136 passes therethrough.

In the elastic member 94, the support hole part 94*a* has an outer diameter same as the outer diameter of the middle part of the bolt shaft 136, and the bolt shaft 136 is inserted thereinto in a relatively rotatable manner. Further, the elastic member 94 has the outer peripheral face 94*b* as a face contacting the support hole part 131*b* of the upper boss part 131. Thus, the elastic member 94 is interposed between the upper boss part 131 and the upper bracket part 132 via the bolt shaft 136 of the connection shaft part 133.

The upper vibration-proof support part 82 provided with the above configuration elastically supports the upper bracket part 132 in a relatively rotatable manner via the elastic member 94 to the upper boss part 131, by the bolt shaft 136 passing through the elastic member 94 provided in the upper boss part 131. The upper vibration-proof support part 82 receives a load from the battery body part 70 via the upper bracket part 132 and bolt shaft 136 to the elastic member 94, thereby obtaining, for the upper boss part 131, an elastic action together with radial compression of the elastic part 103 of the connection shaft part 93.

The gate-shaped frame part 110 that supports the right and left upper vibration-proof support parts 82 provided for the back part of the battery body part 70 as described above is provided in the back part of the base plate part 80. That is, the pair of stay parts 111 included in the gate-shaped frame part 110 stands in the back part of the base plate part 80.

In the present embodiment, the left stay part 111L is placed in the position near the left end part of the support base part 116 so provided as to be along the back edge part of the base plate part 80. Further, the right side stay part 111R is provided on the right end part of the support base part 116.

Then, the battery unit 47, which is supported by the right and left lower vibration-proof support parts 81 and the right and left upper vibration-proof support parts 82, and the electric motor 12 placed below the battery unit 47 are placed below the drive seat 15. That is, as shown in FIG. 6, the excavator 1, in the upper swing body 20B, has the drive part 10 for placing the drive seat 15, and the electric motor 12 and the battery unit 47 are placed below the drive seat 15.

As shown in FIG. 6, below the drive seat 15, the battery unit 47 has substantially the entirety of the battery body part 70 positioned within the drive seat support base 14. The drive seat support base 14 forms a housing space for devices together with the exterior cover part, etc. of the upper swing body 20B; as a face part that forms the housing space, the drive seat support base 14 has a horizontal upper face part 14*a* that supports the drive seat 15 and a front face part 14*b* that stands vertically from the back edge part of the floor part 8.

Then, the battery unit 47 is so provided that the upper face part 71 of the battery body part 70 is positioned directly below the upper face part 14*a* of the drive seat support base 14, and the front face part 14*b* of the battery body part 70 is positioned directly behind the front face part 14*b* of the drive seat support base 14. Further, the battery unit 47 has the lower face part 72 of the battery body part 70 positioned at the height same as the floor part 8. The back sides of the battery unit 47 and gate-shaped frame part 110 are covered with the back cover part 32.

Figure 10:
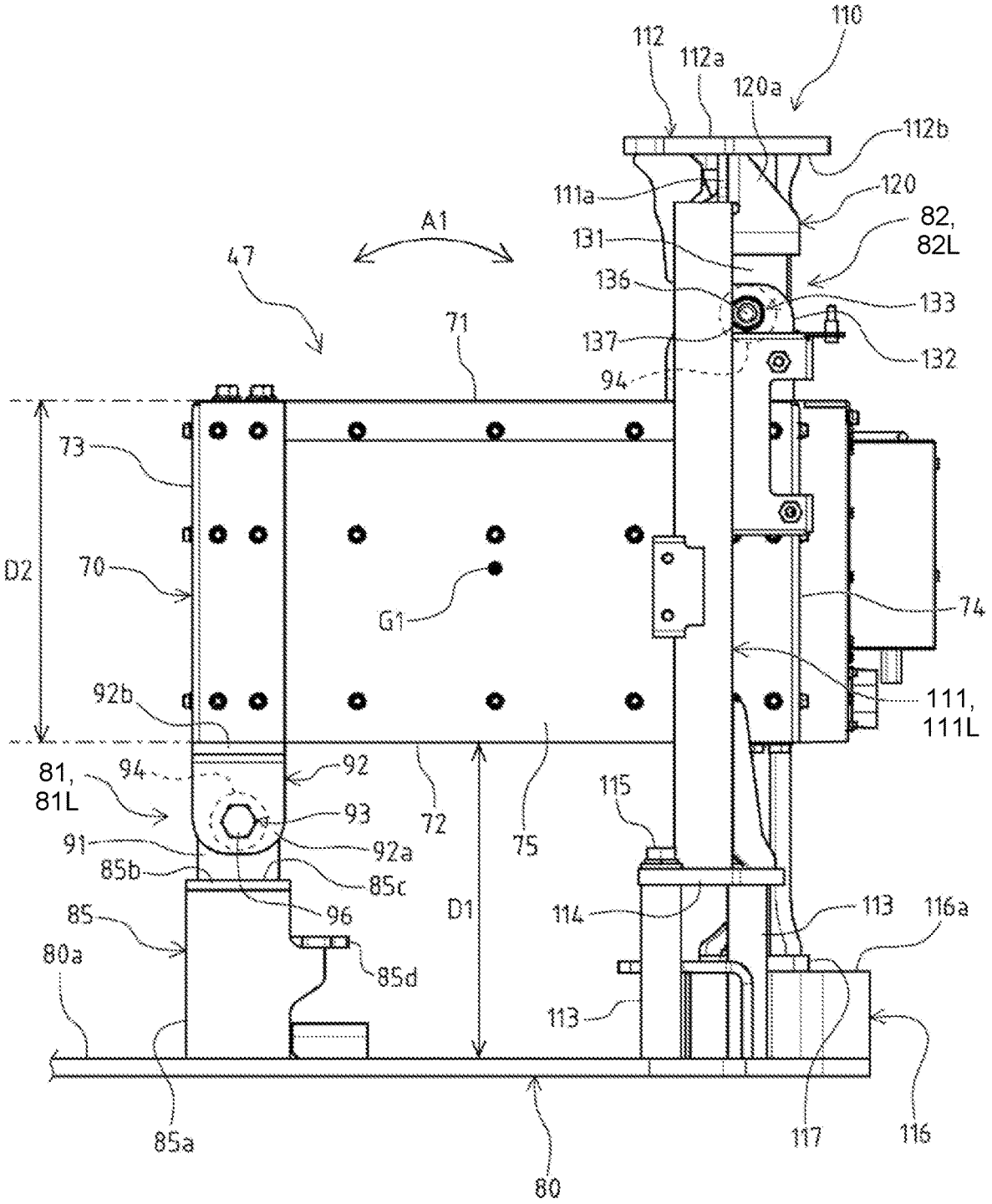
FIG. 10 is a left side view of the support configuration of the battery unit according to the one embodiment of the present invention.

The placement and support configuration of the electric motor 12 are described below. As shown in FIG. 10, on the base plate part 80, the battery unit 47 is provided below the battery body part 70 at a distance D1 of a dimension substantially the same as the up/down dimension D2 of the battery body part 70. The electric motor 12 and the hydraulic pump 41 are placed transversely in a space below the battery body part 70 above the base plate part 80.

Thus, the electric motor 12 is placed below the battery unit 47 in the upper swing body 20B. In particular, the electric motor 12 is so provided as to be entirely or substantially entirely covered from above with the battery body part 70 in plan view.

To the swing frame 7, the electric motor 12 and the hydraulic pump 41 (hereinafter referred to as "motor/pump unit") which are connected to each other via the coupling are supported by a plurality of vibration-proof support parts 140. In the present embodiment, as shown in FIG. 4, the vibration-proof support part 140 is provided in four places: two on the right and left on the front side of the motor/pump unit and two on the right and left on the back side of the motor/pump unit.

Specifically, of the vibration-proof support parts 140 in four places, a vibration-proof support part 140A positioned on the front left side elastically supports the motor/pump unit via a support stay part extending forward from a coupling case 141 casing a coupling. Further, a vibration-proof support part 140B positioned on the front right side elastically supports the motor/pump unit via a support stay part extending forward from a casing of the electric motor 12. Further, a vibration-proof support part 140C positioned on the back left side elastically supports the motor/pump unit via a support stay part extending backward from the coupling case 141. Then, a vibration-proof support part 140D positioned on the back right side elastically supports the motor/pump unit via a support stay part extending backward from the casing of the electric motor 12.

In the vibration-proof support part 140, a support stay extending from the motor/pump unit is supported to a given support part provided on the base plate part 80 of the swing frame 7. The vibration-proof support part 140 includes an elastic part formed by an elastic material such as a rubber material and a fixing portion for fixing the support stay, which is extended from the motor/pump unit, to the given support part on the swing frame 7's side.

It can be said that the excavator 1 of the present embodiment provided with the configuration described above has the following configuration. That is, the excavator 1 is provided with the drive seat 15 placed above the electric motor 12 placed in the back part of the upper swing body 20B. Further, the excavator 1 is provided with the battery unit 47 placed between the electric motor 12 and the drive seat 15. The battery unit 47 has the battery body part 70 positioned between the electric motor 12 and the drive seat 15.

Further, the excavator 1 has a pair of stay parts 111 standing behind the electric motor 12, and the battery unit 47 is suspended by the transverse bridge frame part 112 provided between the pairwise stay parts 111. That is, the back part of the battery unit 47 is supported in a mode being suspended by the right and left upper vibration-proof support parts 82 provided in the transverse bridge frame part 112. Further, in front of the electric motor 12, the excavator 1 is provided with right and left support leg parts 85 and with the lower vibration-proof support parts 81 provided for each of the support leg parts 85, as support parts for the battery unit 47.

Further, the excavator 1 of the present embodiment is so configured that the back end part of the upper swing body 20B is positioned within the width of the right and left crawler-type run parts 5, 5 in the swing motion of the upper swing body 20B with a given position, which is relative to the lower run body 20A, as the swing center. That is, the excavator 1 is so configured that the upper swing body 20B, in its swing motion, is always kept within the width of the right and left run parts 5, 5.

Figure 14:
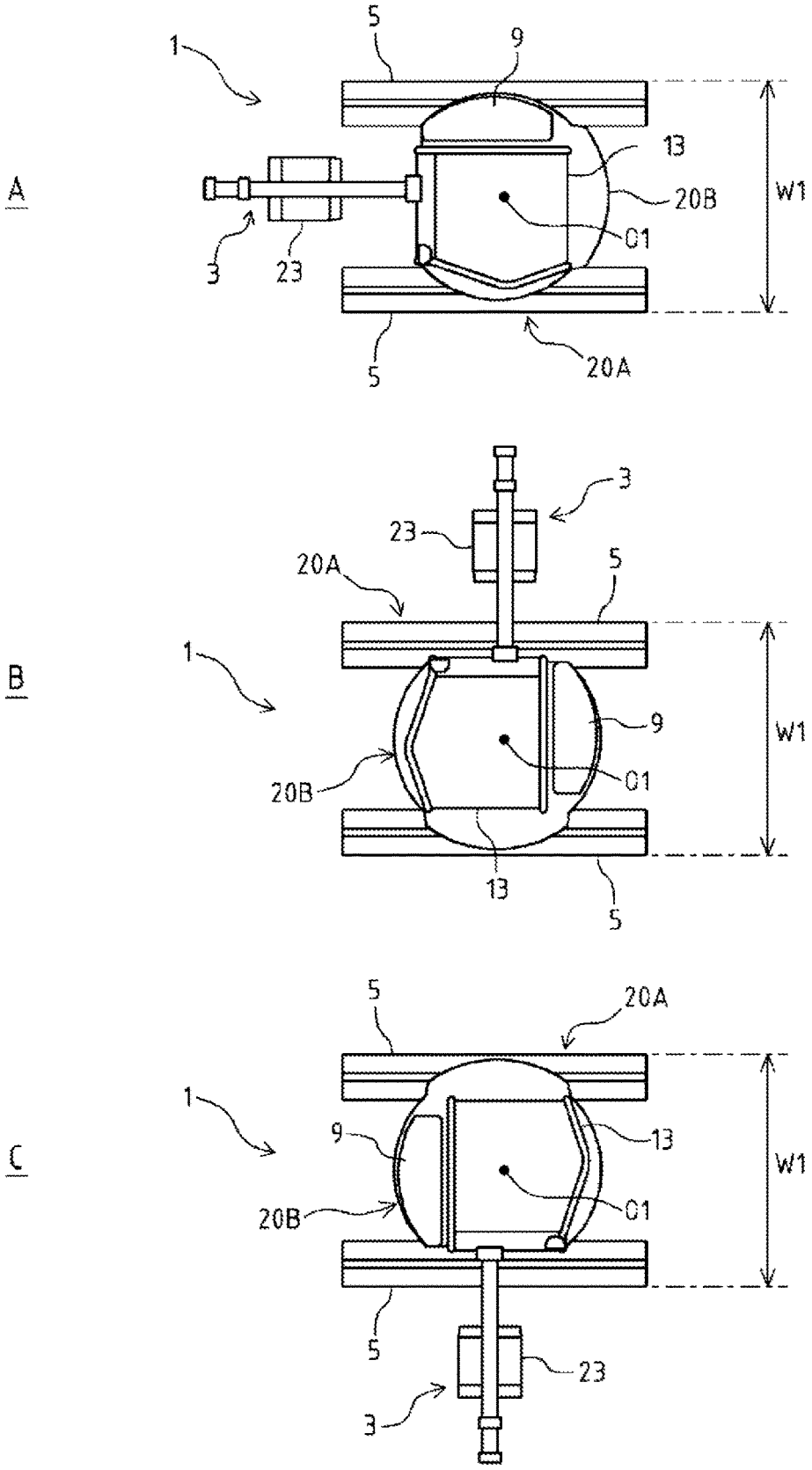
FIG. 14 illustrates a swing configuration of an excavator according to the one embodiment of the present invention.

Specifically, as shown in FIG. 14A, in plan view, the upper swing body 20B has an outline that is along a substantially circumferential shape, and in the back part, an outline along a circular arc shape. The center position of the circumference along the circular arc shape formed by the back part of the upper swing body 20B in plan view or the position near the center position is a swing center O1 of the upper swing body 20B's swing relative to the lower run body 20A. The swing center O1 of the upper swing body is placed in substantially the center of the right and left run parts 5, 5 in the front/back and width directions in plan view. In the upper swing body 20B, the site with the largest distance from the swing center O1, that is, the largest radius of the circle centered on the swing center O1, is the back end part along the circular arc shape in plan view. Further, the counterweight 142 is provided in the back end part of the upper swing body 20B (see FIG. 1).

And, regarding the upper swing body 20B, the diameter of the largest diameter circumference centered on the swing center O1 is smaller than a right/left maximum width W1 of the right and left run parts 5, 5. As shown in FIGS. 14A, 14B and 14C, the excavator 1 is thus so configured that the back end of the upper swing body 20B does not extend outward from the outer edge end of the right and left run parts 5, 5 within the range of the swing motion of the upper swing body 20*b*, in plan view. In other words, the excavator 1 is so configured that, regardless of the upper swing body 20B's direction due to the swing motion, the back end of the upper swing body 20B is positioned within the maximum width W1 of the right and left run parts 5, 5 included in the lower run body 20A.

FIG. 14A shows the state of the state of the upper swing body 20B facing front with respect to the lower run body 20A, FIG. 14B shows the state of the upper swing body facing right with respect to the lower run body 20A, and FIG. 14C shows the state of the upper swing body 20B facing left with respect to the lower run body 20A. Further, the upper swing body 20B is positioned in the front/back center part relative to the run parts 5, 5; thus, even when the upper swing body 20B faces backward with respect to the lower run body 20A, the back end of the upper swing body 20B is positioned within the maximum width W1 of the right and left run parts 5, 5, as well as when the upper swing body 20B faces frontward.

The excavator 1 according to the present embodiment provided with the configuration described above, in the configuration provided with the battery unit 47 for supplying power to the electric motor 12, can effectively suppress the vibration of the battery unit 47 by a simple and inexpensive configuration.

The excavator 1 is provided with the right and left lower vibration-proof support parts 81 that support the lower side of the battery unit 47 and the right and left upper vibration-proof support parts 82 that support the upper side of the battery unit 47, each as the support parts for the battery unit 47; the lower vibration-proof support part 81 is provided on the front side of the battery unit 47, and the upper vibration-proof support part 82 is provided on the back side of the battery unit 47. The above configuration can improve the vibration reduction effect in contrast to, for example, the configuration in which the battery unit 47 is supported at four points on the lower side.

For example, assuming a configuration in which the battery unit 47 is supported at four points at the four lower edges on the lower side of the battery body part 70, the gravitational center of the battery body part 70 is positioned above the four support points in the above support configuration. Thus, the effect of the vibration the battery unit 47 receives from the swing frame 7 during the run and work of the excavator 1 increases, increasing the battery unit 47's displacement amount due to the vibration. For example, when the excavator 1 suddenly starts or stops with the upper swing body 20B facing forward, the vibration of the battery unit 47 will be greater in the front and back direction (see FIG. 10, arrow A1).

Then, according to the support configuration of the battery unit 47 of the present embodiment, the lower vibration-proof support part 81 and the upper vibration-proof support part 82 are placed diagonally in the cuboid-shaped battery body part 70 in side view. Thus, as shown in FIG. 10, the gravitational center G1 of the battery body part 70 is positioned between the lower vibration-proof support part 81 and the upper vibration-proof support part 82 in side view, in the up/down and front and back directions, respectively.

This allows the force, which attempts to displace the battery unit 47 due to the vibration of the swing frame 7, to act more directly on the elastic part 103 of the elastic member 94, thus making it possible to reduce the effect of the vibration the battery unit 47 receives from the swing frame 7 in the upper swing body 20B. In particular, the support configuration of the battery unit 47 of the present embodiment can effectively absorb the front/back swing of the battery unit 47 (see FIG. 10, arrow A1) in addition to the up/down vibration.

Further, according to the support configuration of the battery unit 47 of the present embodiment, the effect of suppressing the vibration of the battery unit 47 can be improved without increasing the number of points for supporting by the vibration-proof support parts (81, 82), in contrast, for example, with the configuration in which the battery unit 47 is supported at four points on the lower side. This makes it possible to obtain an inexpensive and simple configuration that can effectively absorb the vibration of the battery unit 47 without increasing cost or complicating the structure.

Further, suppressing the vibration of the battery unit 47 makes it possible to effectively use the housing space for the battery unit 47. That is, since the battery unit 47's displacement amount as the vibration is reduced, the size of the gap secured relative to the driver seat support base 14's upper face part 14*a*, front face part 14*b*, etc. which form the housing space for the battery unit 47 can be reduced so as to avoid an interference with these face parts, thus making it possible to efficiently use the limited space. This can contribute to the downsizing of the upper swing body 20B.

Further, in the excavator 1 of the present embodiment; for the battery unit 47, the right and left lower vibration-proof support parts 81 are provided in the front end part of the battery body part 70, and the right and left upper vibration-proof support parts 82 are provided in the back end part of the battery body part 70. According to the above configuration, the upper face part 71 of the battery body part 70 can be made flat on the front side of the site for placing the upper vibration-proof support part 82, thus making it possible to efficiently use the space for placing the battery unit 47.

Specifically, for example, the flat shape is secured on most of the front side of the upper face part 71 of the battery body part 70; thus, the upper face part 14*a* of the drive seat support base 14 can be as close to the battery body part 70 as possible, making it possible to effectively use the space in the drive seat support base 14. Further, in the present embodiment, the support base part 116 which is the support part for the counterweight 142 can be used as the support part for the gate-shaped frame part 110 for providing the upper vibration-proof support part 82, thus making it possible to effectively use the space for placing the battery unit 47.

Further, in the excavator 1 of the present embodiment, the right and left upper vibration-proof support parts 82 are suspended by the transverse bridge frame part 112 between the right and left stay parts 111 standing on the base plate part 80. According to the above configuration of the present embodiment, the right and left upper vibration-proof support parts 82 are fixed via the stay parts 111 and transverse bridge frame part 112 to the base plate part 80 side, thus making it possible to effectively suppress the battery unit 47's vibration in the up/down and front and back directions.

Further, in the excavator 1 of the present embodiment, each of the lower vibration-proof support part 81 and upper vibration-proof support part 82 has the configuration in which the mount part (lower boss part 91, upper boss part 131) provided on the swing frame 7 side, and the mount part (lower bracket part 92, upper bracket part 132) provided on the battery unit 47 side are connected via the elastic members 94. According to the above configuration, the vibration of the battery unit 47, by a simple configuration, can be effectively absorbed by the elastic action of the elastic member 94.

In particular, the elastic member 94 is cylindrically configured including the cylindrical-shaped elastic part 103, and is provided in the state where the connection shaft part 93 penetrates with the elastic member 94's central axial direction in the right/left direction. The above configuration makes it possible to effectively absorb the battery unit 47's vibration in the up/down and front and back directions.

Further, the electric motor 12 and the battery unit 47 require a large placement space compared with other devices. Thus, when the electric motor 12 and the battery unit 47 are placed in a flat manner, such as a side-by-side placement, for example, the space required below the drive seat 15 becomes large. This leads to an increase in the swing radius of the upper swing body 20B due to the larger size of the upper swing body 20B, causing a loss of workability by the excavator 1.

Then, in the excavator 1 of the present embodiment, the electric motor 12 is placed below the battery unit 47. According to the above configuration, the electric motor 12 and the battery unit 47, which require a relatively large placement space, can be placed above and below, thus making it easy to secure the space for other devices. This allows for efficient placement of devices in the space below the drive part 10, making it possible to obtain a configuration proper for a small construction machine having a relatively narrow space below the drive part 10.

In particular, in the present embodiment, the electric motor 12 is placed below the battery unit 47 as the motor/pump unit that includes the hydraulic pump 41. The above configuration allows for an efficient use of the space below the drive part 10.

In the excavator 1 according to the present embodiment, the drive seat 15 is placed above the electric motor 12 and the battery unit 47, and a pair of stay parts 111 for providing the upper vibration-proof support part 82 stands in the back part of the base plate part 80. According to the above configuration, the electric motor 12 and the battery unit 47, which require a relatively large placement space, can be placed above and below, thus making it possible to suppress the backward protrusion of the upper swing body 20B. This makes it possible to reduce the swing radius for the swing motion of the upper swing body 20B, making it possible to obtain a configuration proper for a small construction machine.

In particular, in the present embodiment; on the base plate part 80, the hydraulic oil tank 30 placed in the right side part of the front part is placed adjacent to the radiator 61 provided together with the electric fan 62 on the right side of the electric motor 12 placed in the back part. The above configuration makes it possible to efficiently place various types of devices in the space below the drive part 10.

Further, in the excavator 1 of the present embodiment, the drive seat 15 is placed above the electric motor 12 placed in the back part of the swing frame 7. According to the above configuration, the electric motor 12, which requires a relatively large placement space, can be provided in a place where a space is easily available, making it easier to secure a space for placing other devices. This allows for an efficient use of the space, making it possible to obtain a configuration proper for a small construction machine having a relatively small space below the drive part 10.

In particular, in the present embodiment, the battery unit 47 is placed between the electric motor 12 and the drive seat 15. According to the above configuration, the electric motor 12 and the battery unit 47, which require a relatively large placement space, can be provided in a place where a space is easily available, making it further easier to secure a space for other devices. This allows for an efficient placement of devices, making it possible to obtain a configuration proper for a small construction machine.

Further, the excavator 1 of the present embodiment is provided with the support configuration for the battery unit 47, in which configuration the battery unit 47 is suspended by the upper vibration-proof support part 82 between the pairwise stay parts 111 standing behind the electric motor 12. The above configuration makes it possible to compactly configure the support device for the battery unit 47, making it possible to obtain, without squeezing the space of the drive part 10, a configuration proper for a small construction machine having a relatively small space below the drive part 10.

In particular, in the present embodiment, the right and left lower vibration-proof support parts 81 are provided in front of the electric motor 12. The above configuration makes it possible, by a compact and simple configuration, to effectively suppress the vibration of the battery unit 47.

Further, the excavator 1 according to the present embodiment is so configured that the upper swing body 20B is placed within the width of the right and left crawler-type run parts 5, 5 in plan view. According to the above configuration, the placement configuration of devices such as the battery unit 47 can be made compact, and the back end part of the upper swing body 20B can be prevented from protruding from the width of the right and left run parts 5, 5 or the protruding can be reduced, thus making it possible to obtain good workability for the work by the excavator 1.

The above description of the embodiment is merely one example of the present invention, and the construction machine according to the present invention is not limited to the above embodiment. Accordingly, it is needless to say that, even to those other than the above embodiment, various modifications can be made according to the design and the like within the scope that does not depart from the technical concept of the present invention. Further, the effects described in the present disclosure are merely illustrative and are not limited, and any other effect may also be exerted.

In the embodiment described above, the lower vibration-proof support part 81 is provided on the front side of the battery unit 47, and the upper vibration-proof support part 82 is provided on the back side of the battery unit 47, but the position of placing the lower and upper vibration-proof support parts 81 and 82 in the front and back direction is not particularly limited. For example, symmetrically with the embodiment described above, it may be so configured that, for the battery unit 47, the right and left lower vibration-proof support parts 81 are provided on the back side and the right and left upper vibration-proof support parts 82 are provided on the front side, respectively. Further, for example, it may be so configured that one of the right and left lower vibration-proof support parts 81 is provided on the front side and the other of the lower vibration-proof support parts 81 is provided on the back side, respectively, and one of the right and left upper vibration-proof support parts 82 is provided on the back side and the other of the upper vibration-proof support part 82 is provided on the front side, respectively.

DESCRIPTION OF REFERENCE NUMERALS

1 excavator (construction machine)
2: run device
5: run part
7 swing frame (frame)
10 drive part
12 electric motor
15 drive seat
20A lower run body
20B upper swing body (machine body)
41 hydraulic pump
47 battery unit
70 battery body part
80 base plate part
81 lower vibration-proof support part
82 upper vibration-proof support part
91 lower boss part (first mount part)
92 lower bracket part (second mount part)
93 connection shaft part
94 elastic member
96 bolt shaft
110 gate-shaped frame part
111 stay part
112 transverse bridge frame part
131 upper boss part (first mount part)
132 upper bracket part (second mount part)
133 connection shaft part
136 bolt shaft

The invention claimed is:

1. A construction machine comprising:
a turning frame;
a frame structure standing on the turning frame;
a driver seat above the turning frame; and
a battery unit for supplying electric power to an electric motor,
wherein the battery unit is suspended from the frame structure on the turning frame, and the battery unit is located directly below the driver seat.

2. The construction machine as claimed in claim 1, wherein the frame structure comprises a pair of column portions extending upward and a beam portion bridging the column portions.

3. The construction machine as claimed in claim 2, wherein the pair of column portions are disposed on the turning frame with a spacing wider than a width direction of the battery unit.

4. The construction machine as claimed in claim 3, wherein the battery unit is suspended and supported by at least two support portions provided on the beam portion.

5. The construction machine as claimed in claim 4, wherein an inner distance between the two support portions is smaller than a width direction of the battery unit.

6. The construction machine as claimed in claim 1, wherein the battery unit is supported at a rear side in a front and back direction of the turning frame by the support portions.

7. The construction machine as claimed in claim 6, wherein the battery unit is provided, on an upper surface side thereof, with connection portions to the support portions.

8. The construction machine as claimed in claim 7, wherein the battery unit is supported on the turning frame at a front side in a front and back direction of the turning frame.

9. A construction machine comprising:
a turning frame;
a frame structure standing on the turning frame;
a roof unit above the frame structure;
a driver seat above the turning frame; and
a battery unit for supplying electric power to an electric motor,
wherein the battery unit is suspended from the frame structure on the turning frame,
the frame structure is located directly below a rear end member of the roof unit, and the battery unit is located directly below the driver seat.

* * * * *